US007209871B2

(12) United States Patent
Gupta

(10) Patent No.: US 7,209,871 B2
(45) Date of Patent: Apr. 24, 2007

(54) PREDICTION OF CAVITY SIZE IN THE PACKED BED SYSTEMS USING NEW CORRELATIONS AND MATHEMATICAL MODEL

(75) Inventor: Govind Sharan Gupta, Karnatka (IN)

(73) Assignee: Council of Scientific and Industrial Research, New Delhi (IN)

( * ) Notice: Subject to any disclaimer, the term of this patent is extended or adjusted under 35 U.S.C. 154(b) by 698 days.

(21) Appl. No.: 10/628,289

(22) Filed: Jul. 29, 2003

(65) Prior Publication Data

US 2005/0027493 A1 Feb. 3, 2005

(51) Int. Cl.
*G06F 17/10* (2006.01)

(52) U.S. Cl. ..... 703/2; 703/6; 703/7; 75/378; 266/197

(58) Field of Classification Search ..... 703/2, 703/6, 7; 356/5; 75/378, 375; 700/44
See application file for complete search history.

(56) References Cited

U.S. PATENT DOCUMENTS 4,976,780 A * 12/1990 Amano et al. ..... 75/375
5,223,908 A * 6/1993 Scott et al. ..... 356/5.06
6,090,181 A * 7/2000 Sakurai et al. ..... 75/378
7,149,590 B2 * 12/2006 Martin et al. ..... 700/44

FOREIGN PATENT DOCUMENTS

JP 02002256316 A * 9/2002

OTHER PUBLICATIONS

"Partical-scale modeling of gas-solid flow in Fluidization", Yu et al, Journal of Chemical Technology and Biotechnology, Oct. 2002.*

"Numerical simulation of the gas-solid flow in bed with lateral gas blasting", Xu et al, Power Technology 109, Elsevier Science 2000.*

"Iron and Steelmaking Facility Planning Simulation Model", Kock, Winter Simulation Conference 1979, IEEE 1979.*

(Continued)

*Primary Examiner*—Fred Ferris
(74) *Attorney, Agent, or Firm*—Pillsbury Winthrop Shaw Pittman LLP

(57) ABSTRACT

It has been reported in the literature that raceway measurement made during the decreasing gas velocity is relevant to operating blast furnaces. However, no raceway correlation is available either for decreasing or increasing gas velocity which is developed based on a systematic study and none of the available correlation take care of frictional properties of the material. Therefore, a systematic experimental study has been carried out on raceway hysteresis. Based on experimental data and using dimensional analysis, two raceway correlations, one each for increasing and decreasing gas velocity, have been developed. Also, in the present study the effect of stresses has been considered along with pressure and bed weight terms mathematically. These three forces are expressed in mathematical form and solved analytically for one-dimensional case, using a force balance approach. Based on the force balance approach a general equation has been obtained to predict the size of the cavity in each case, i.e., for increasing and decreasing velocity. Results of these correlations and model have been compared with the data obtained from literature on cold and hot models and plant data along with some experimental data. An excellent agreement has been found between the predicted (using correlations and model) and experimental values. The proposed theory is applicable to any packed bed systems. It has been shown that hysteresis mechanism in the packed beds can be described reasonably taking into consideration the reversal of sign in frictional forces in increasing and decreasing velocity cases.

9 Claims, 14 Drawing Sheets

Experimental Cavity hysteresis with the packed bed

OTHER PUBLICATIONS

Apte, V.B et al., "Stress Distribution in a Packed Bed Above Raceway Cavities Formed by an Air Jet", *AIChE Journal*, vol. 36, No. 3, pp. 461-468 (Mar. 1990).

Apte, V.B. et al., "Gas Flows in Raceways Formed by High Velocity Jets In a Two-Dimensional Packed Bed", *Chem. Eng. Res. Des.*, vol. 68, pp. 357-362 (Jul. 1988).

Chong, Y.O. et al., "Operating Mechanism of a Conical Fluidized Bed", *Fluidization and Industrial Applications*, Chapter 36, pp. 1127-1144, no date.

Doyle, III, F.J. et al., "The Phenomenon of Pinning in an Annular Moving Bed Reactor with Crossflow of Gas", *Chemical Engineering Science*, vol. 41, No. 6, pp. 1485-1495 (1988).

Elliott, J.F. et al., "Physical Conditions in the Combustion and Smelting Zones of a Blast Furnace", *Journal of Metals*, pp. 709-717 (Jul. 1952).

Flint, P.J. et al., "A Fundamental Study of Raceway Size in Two Dimensions", *Metallurgical Transactions B*, vol. 23B, pp. 267-283 (Jun. 1992).

Hatano, M. et al., "Analysis of the Combustion Zone in the Experimental Blast Furnace", *Transactions ISIJ*, vol. 17, pp. 102-109 (1977).

Jackson, R. et al., "Shorter Communication Further Consideration of the Effect of Aeration on the Flowability of Powders", *Trans IchemE*, vol. 59, pp. 119-121 (1981).

Lister, J.D. et al., "Size Hysteresis in a Two Dimensional Model Raceway", *The Nineteenth Australasian Chemical Conference Newcastle, Australia*, 18th—20th, pp. 478-483, Sep. 1991.

MacDonald, J.F. et al., "Void Formation in Stationary and Moving Beds", *Chemical Engineering Science*, vol. 52, No. 5, pp. 677-691 (1977).

Nishi, Tetsu et al., "Relationship between Shape of Raceway and Productivity of Blast Fumace Taking Account of Properties of Coke Sampled at Tuyere Level", *Transctions ISIJ*, vol. 22, pp. 287-296 (1982).

Povermo, J.J. et al., "An Experimental Measurement of Raceway Dimensions in Bethlehem Steel Corporation's Bethlehem, Pa. Plant", pp. 383-401, no date.

Sarkar, S. et al., "A Cold Model Study of Raceway Hysteresis", *Metallurgical and Materials Transactions B. vol. 34B*, pp. 183-191 (Apr. 2003).

Sastry, G.S.S.R.K. et al., "Cold Model Study of Raceway Under Mixed Particle Conditions", *Ironmaking and Steelmaking*, vol. 30, No. 1, pp. 61-65 (2003).

Sastry, G.S.S.R.K. et al., "Void Formation and Breaking in a Packed Bed", *ISIJ International*, vol. 43, No. 2, pp. 153-160 (2003).

Szekely J. et al., "A Mathematical and Physical Representation of the Raceway Region in the Iron Blast Furnace", *Metallurgical Transactions B*, vol. 6B, pp. 119-129 (Mar. 1975).

Tsinontides, S.C. et al., "The Mechanics of Gas Fluidized Beds with an Interval of Stable Fluidization", *J. Fluid Mech.*, vol. 255, pp. 237-274 (1993).

Wagstaff, J.B. et al., "Comparison of Blast Furnace Penetration with Model Studies", *Journal of Metals*, pp. 370-376 (Mar. 1957).

* cited by examiner

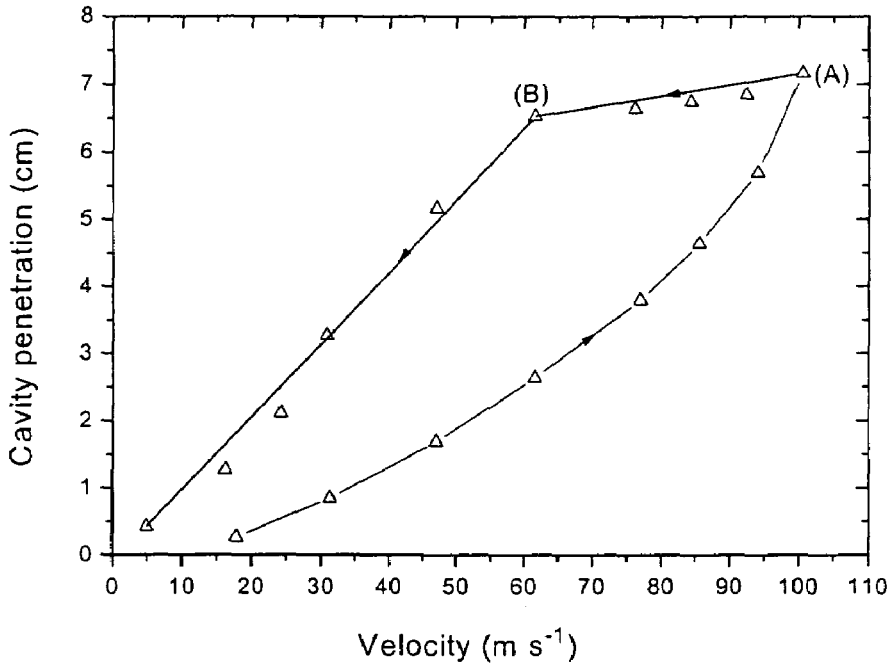
Figure 1: Experimental Cavity hysteresis with the packed bed
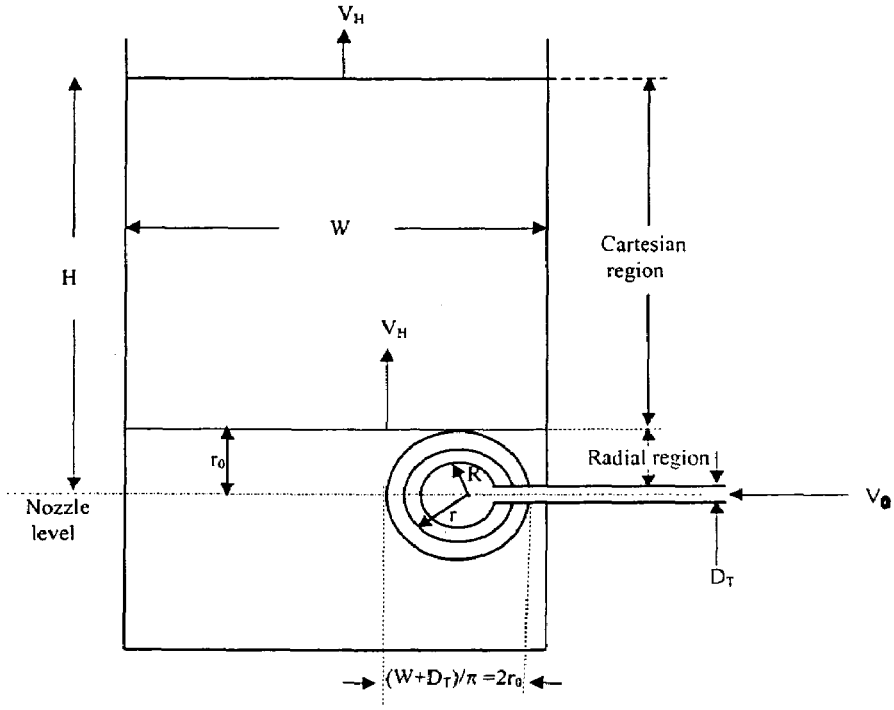
Figure 2. Packed bed showing the essential regions used for modeling.

Figure 3. Forces acting on an element in the cartesian region.
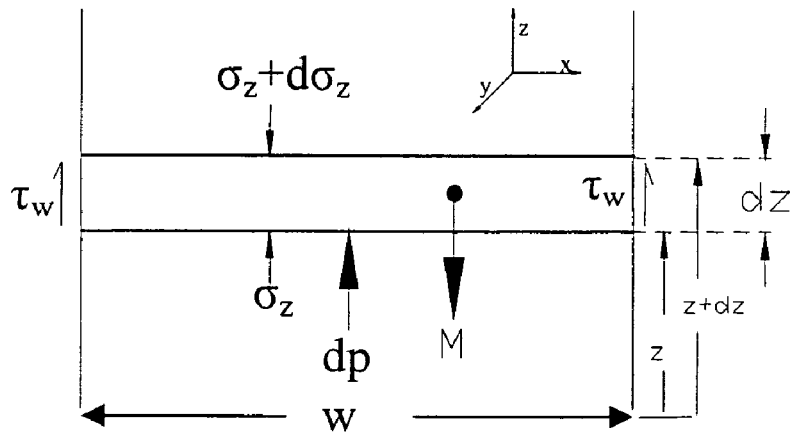
Figure 4. Forces acting on an element in the radial region.
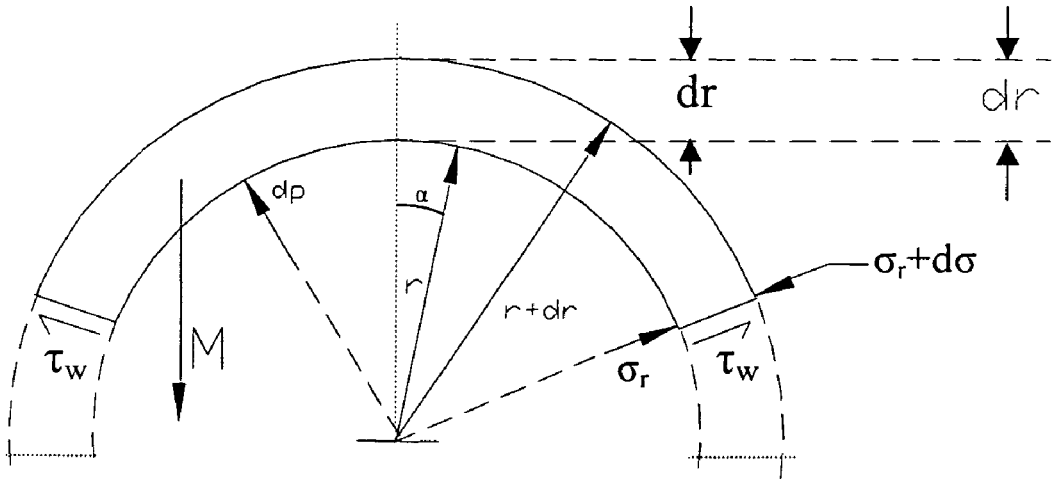

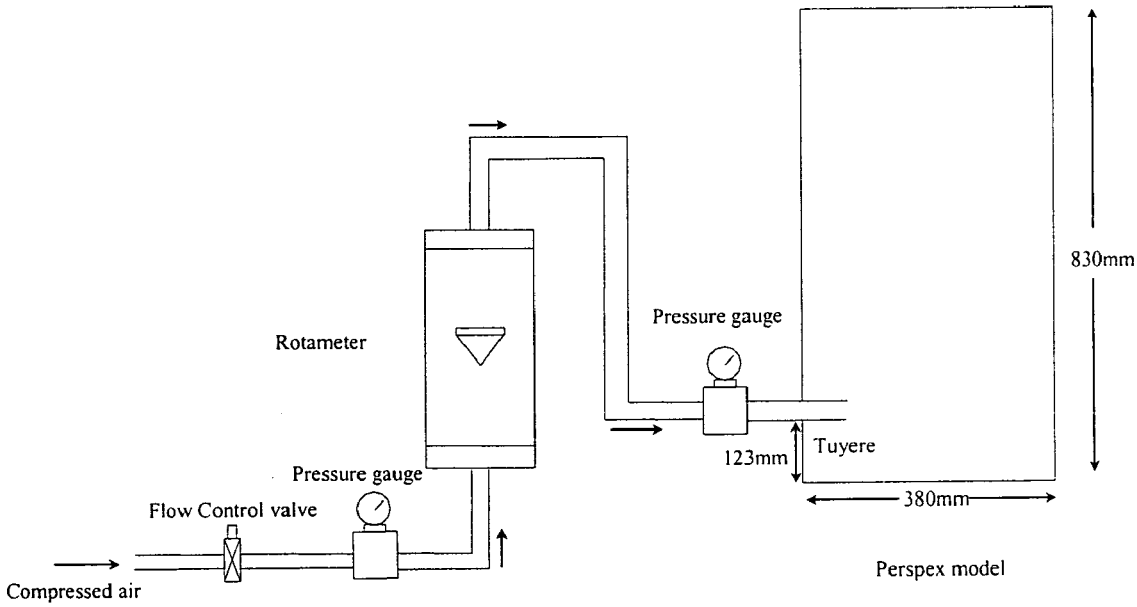
Figure 5. Schematic diagram of experimental setup
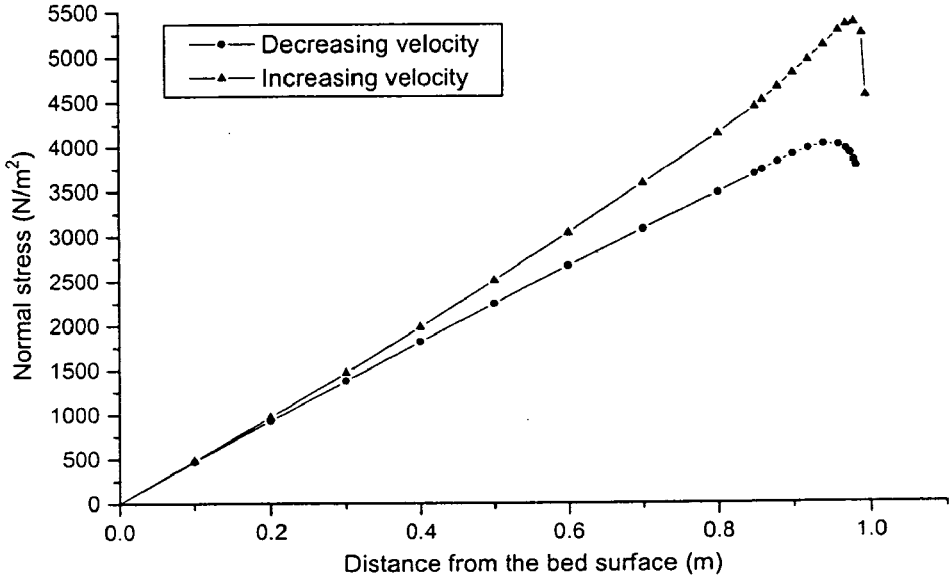
Figure 6. Hysteresis curve of normal stress at velocity = 40 m/s

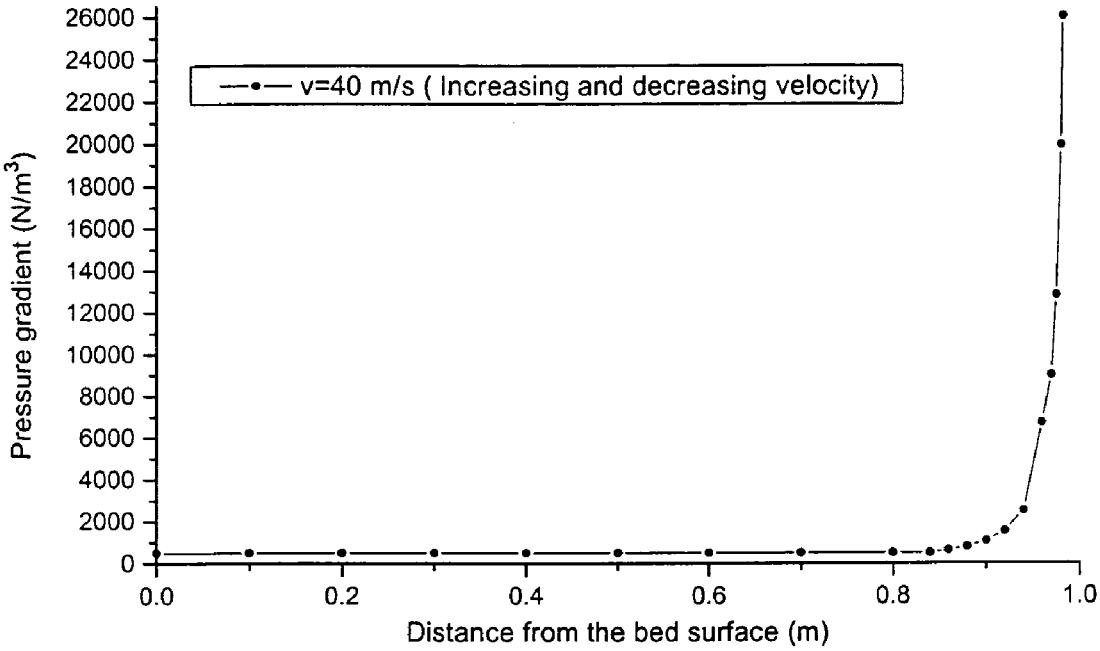
Figure 7. Variation of pressure gradient with distance from the bed surface.
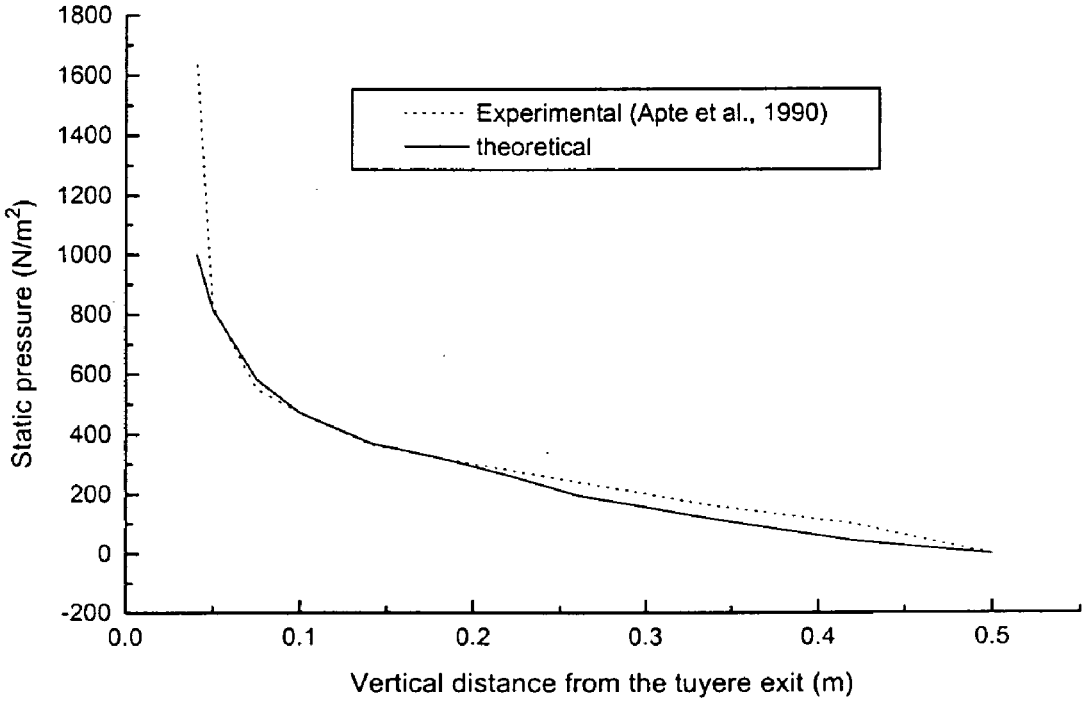
Figure 8. Comparison of static pressure with experimental data.

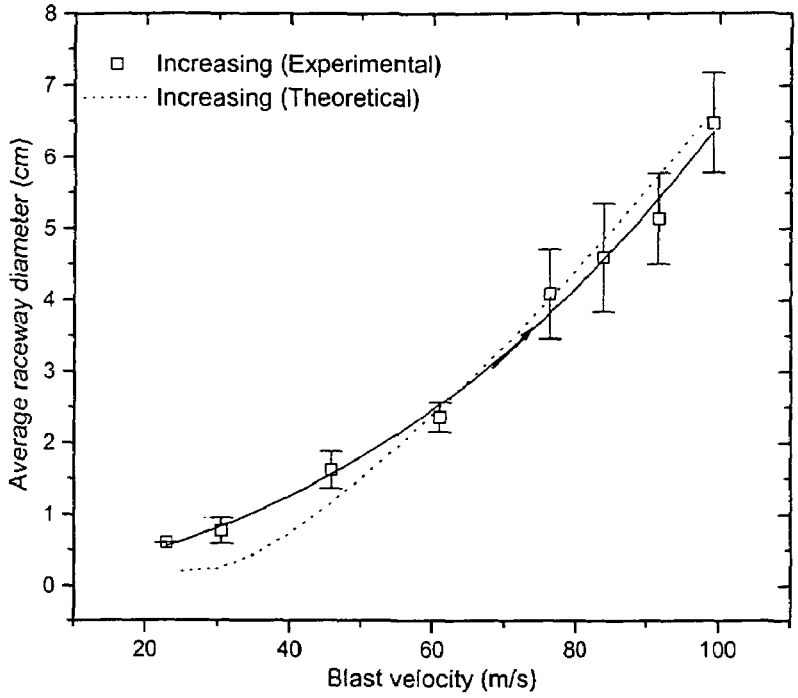
Figure 9. A comparison between theoretical and experimental cavity size for increasing velocity.
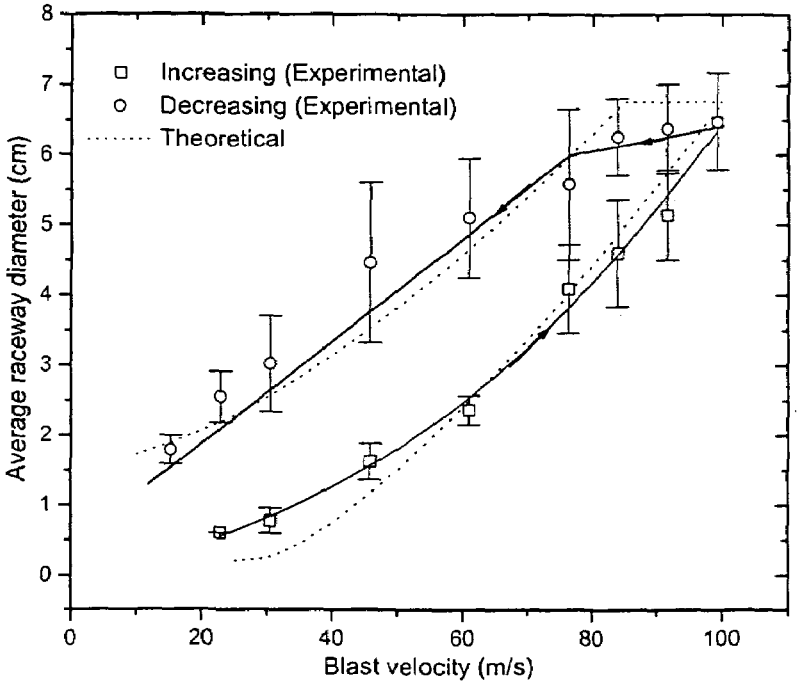
Figure 10. A comparison between theoretical and experimental cavity hysteresis.

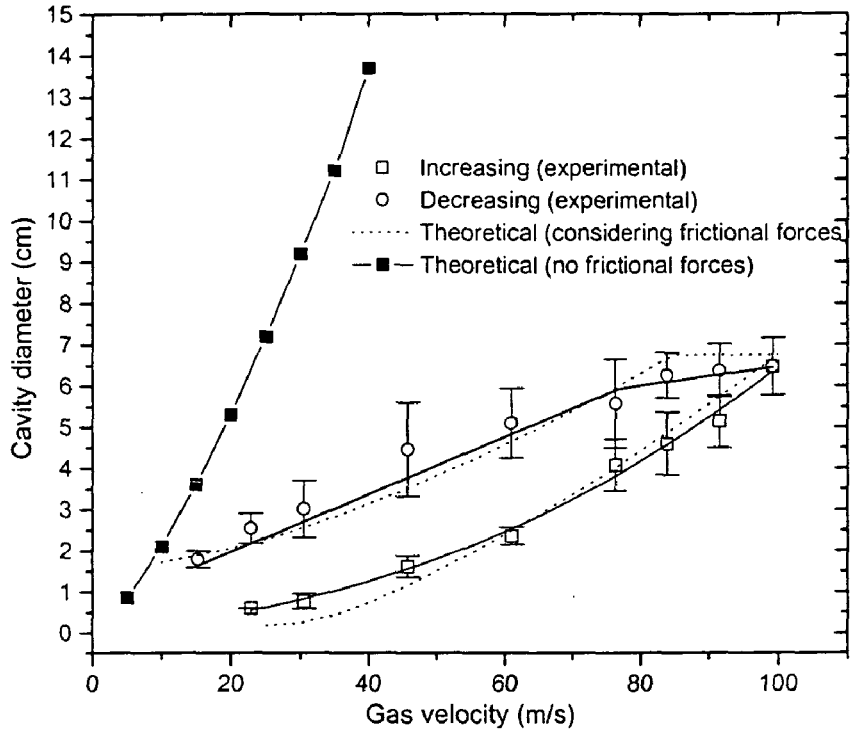
Figure 11. A comparison between theoretical cavity size considering and not considering the frictional forces.
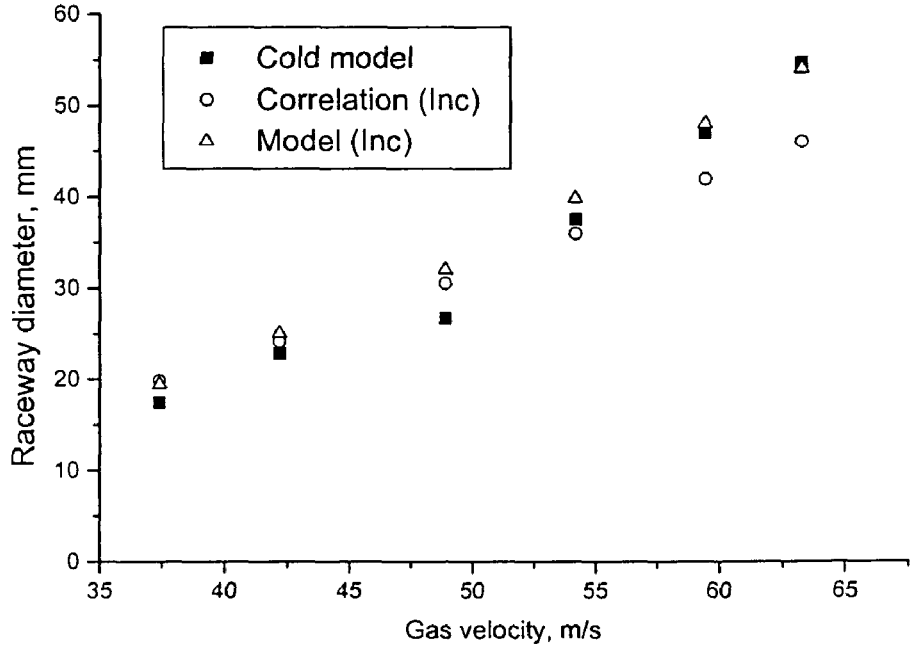
Figure 12. Comparison of correlation raceway size with published Flint and Burgess (1992) data of 3mm polystyrene.

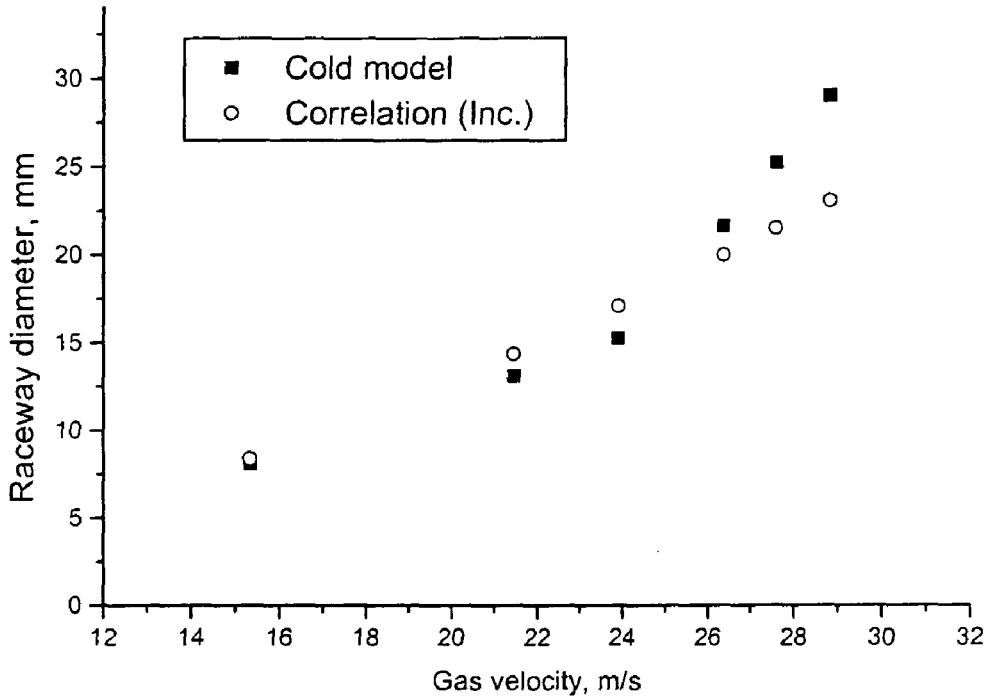
Figure 13. Comparison of correlation raceway size with published Flint and Burgess (1992) data of 0.725mm ballotini glass.
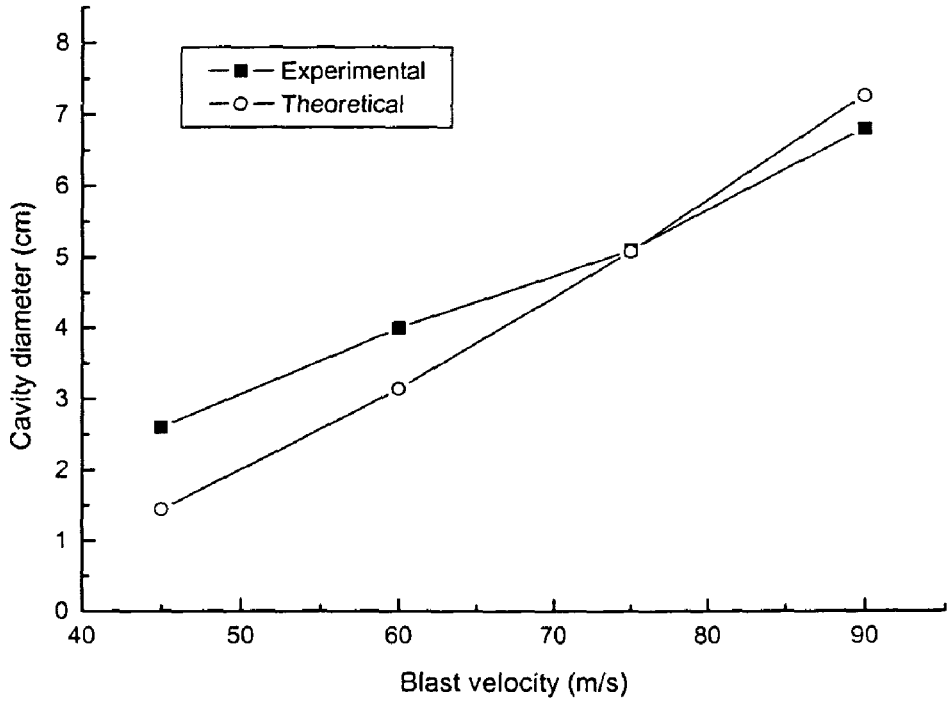
Figure 14. Comparison of model's prediction with experimental (Born, 1991) values of cavity size.

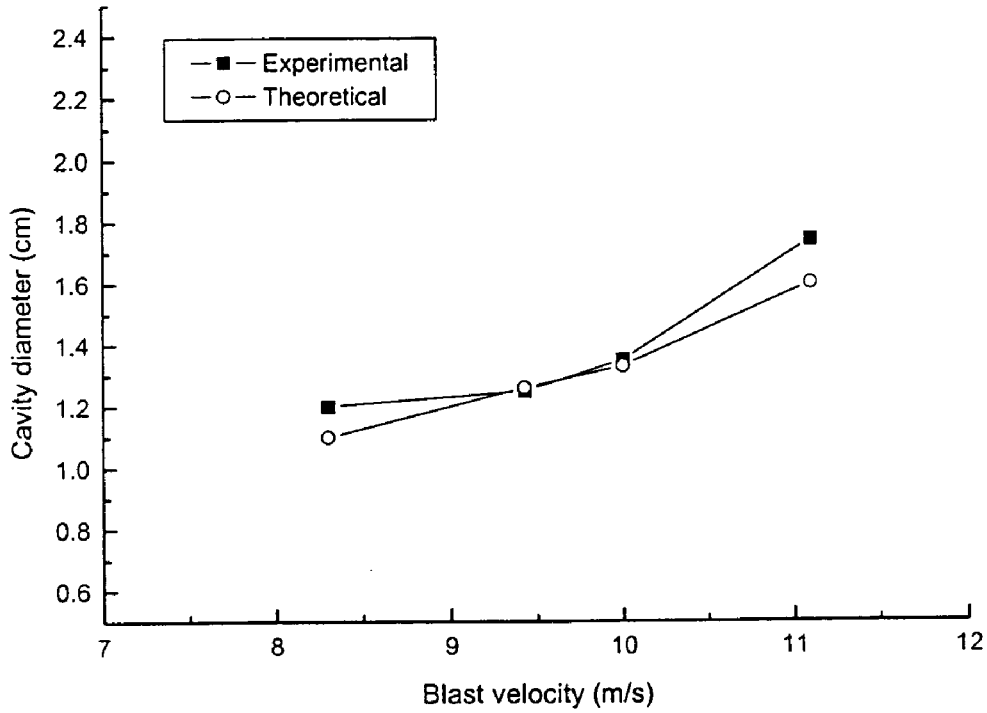
Figure 15. Comparison of experimental (Sastry, 2000) and theoretical values of cavity size.
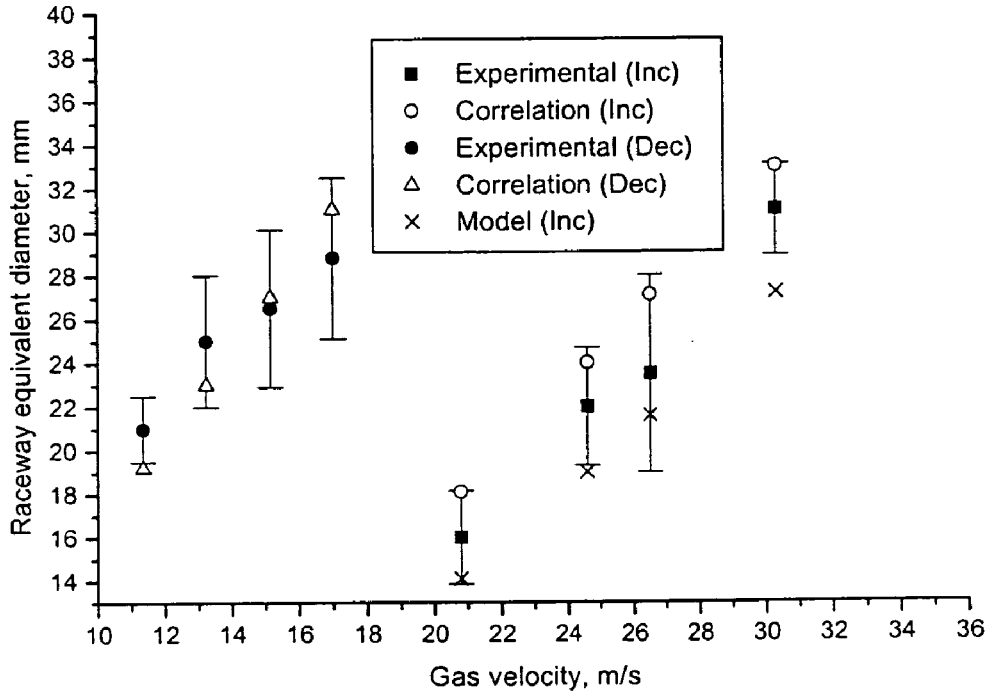
Figure 16. Comparison of raceway size between experimental and correlation in both increasing and decreasing velocity.

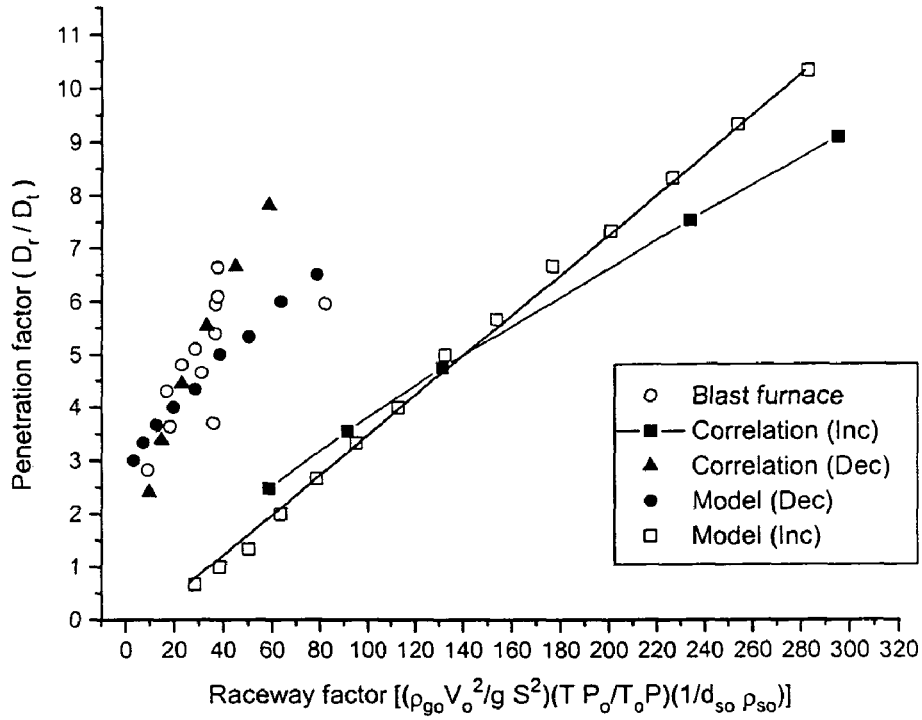
Figure 17. Comparison of blast furnace (Hatano et al., 1977) and experimental data for both increasing and decreasing velocity conditions.
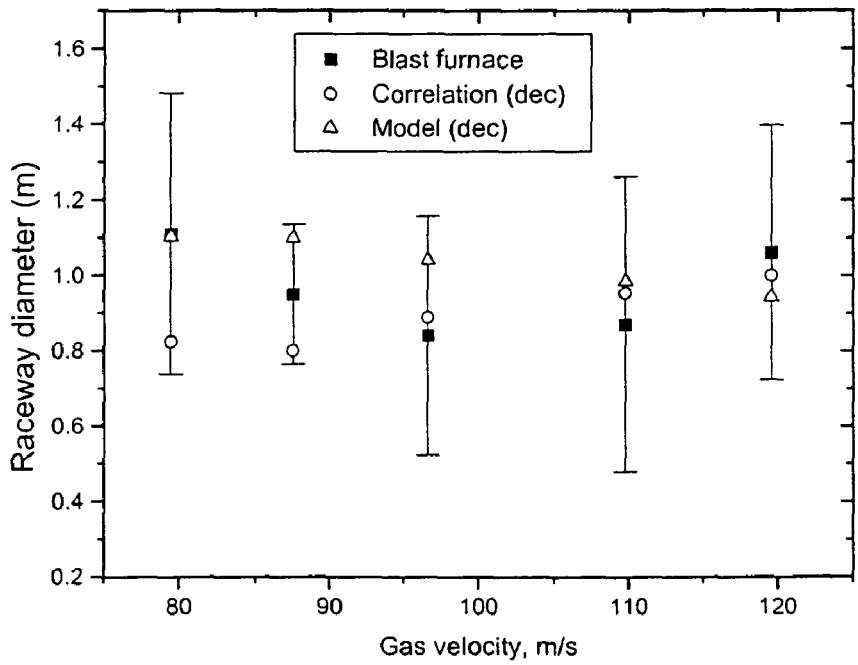
Figure 18. Comparison of correlation raceway size with published (Wgastaff, 1957) blast furnace data.

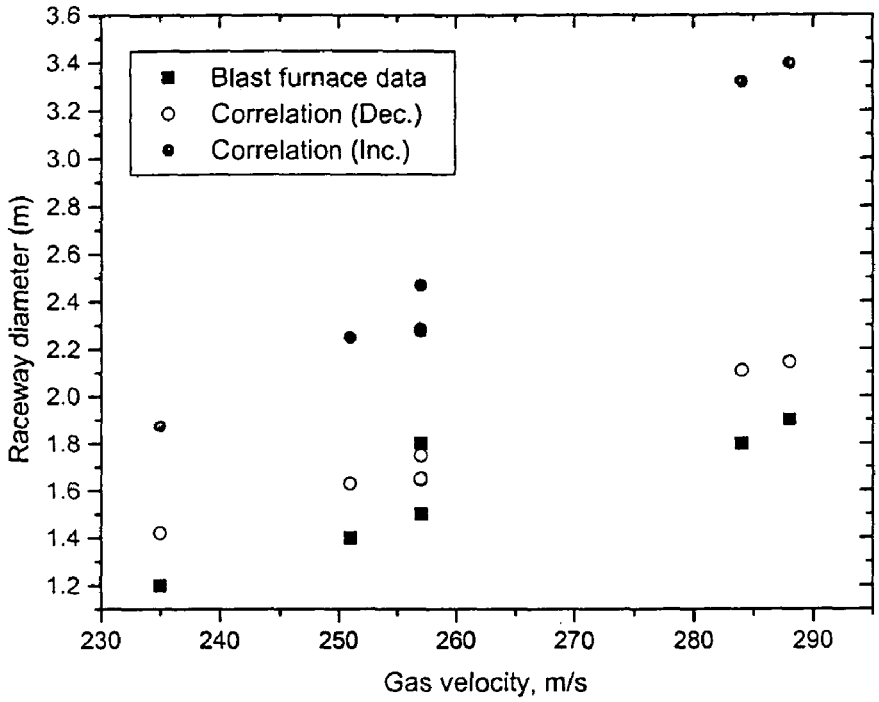
Figure 19. Comparison of correlation raceway size with published blast furnace data of Nishi et al., 1982.
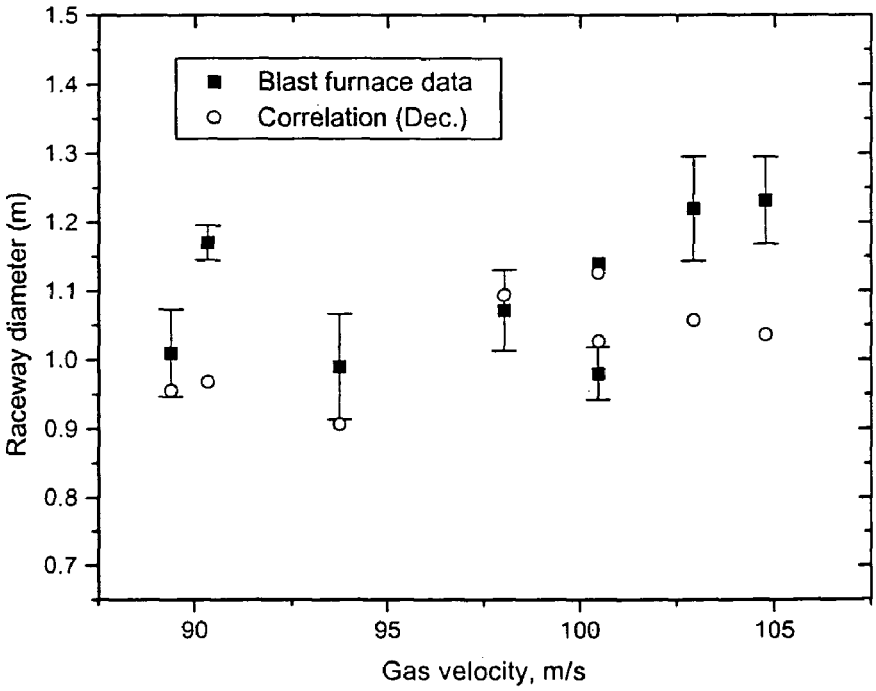
Figure 20. Comparison of correlation raceway size with published blast furnace data of Poveromo et al., 1975.

Figure 21: Determination of Cavity/Raceway Size in packed bed like Ironmaking & Lead Blast furnaces, Corex, Cupola, etc. for decreasing gas velocity Based on Mathematical Model
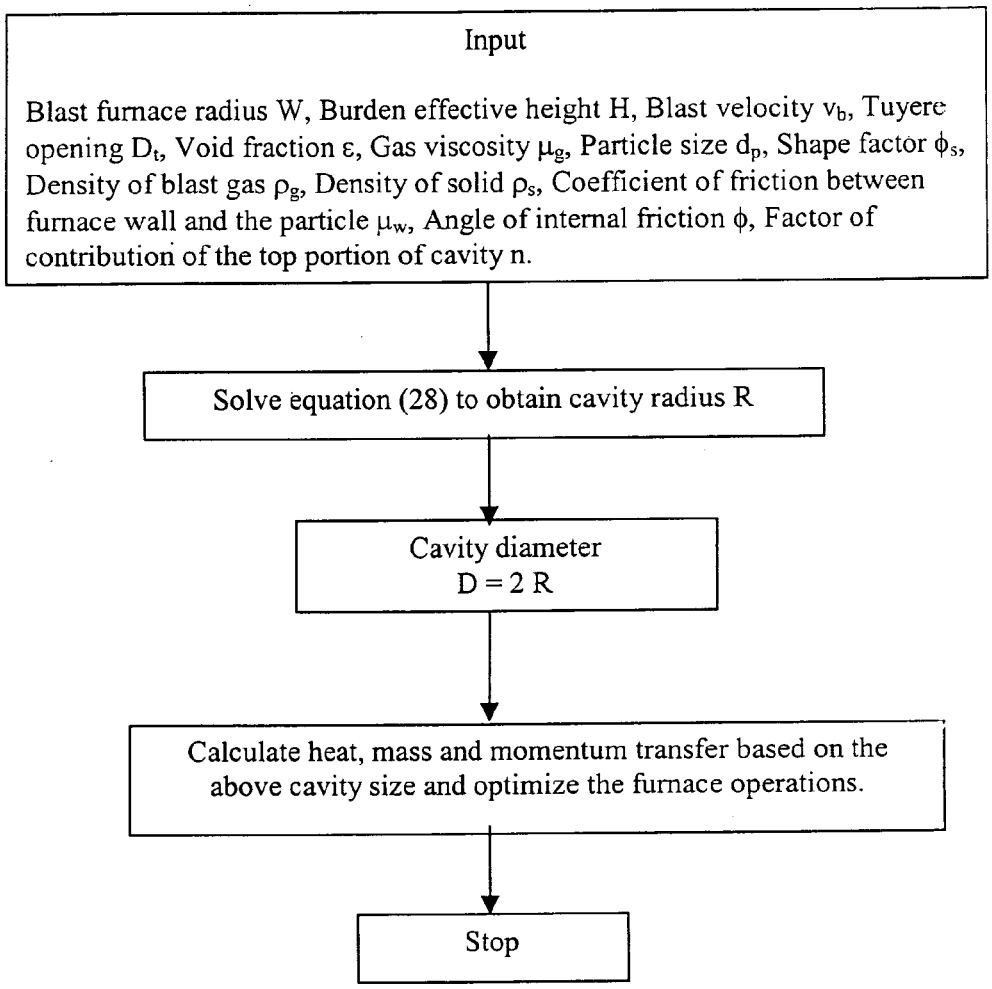

Figure 22: Determination of Cavity/Raceway Size in packed bed like Ironmaking & Lead Blast furnaces, Corex, Cupola, etc. for decreasing gas velocity Based on Decreasing Correlation
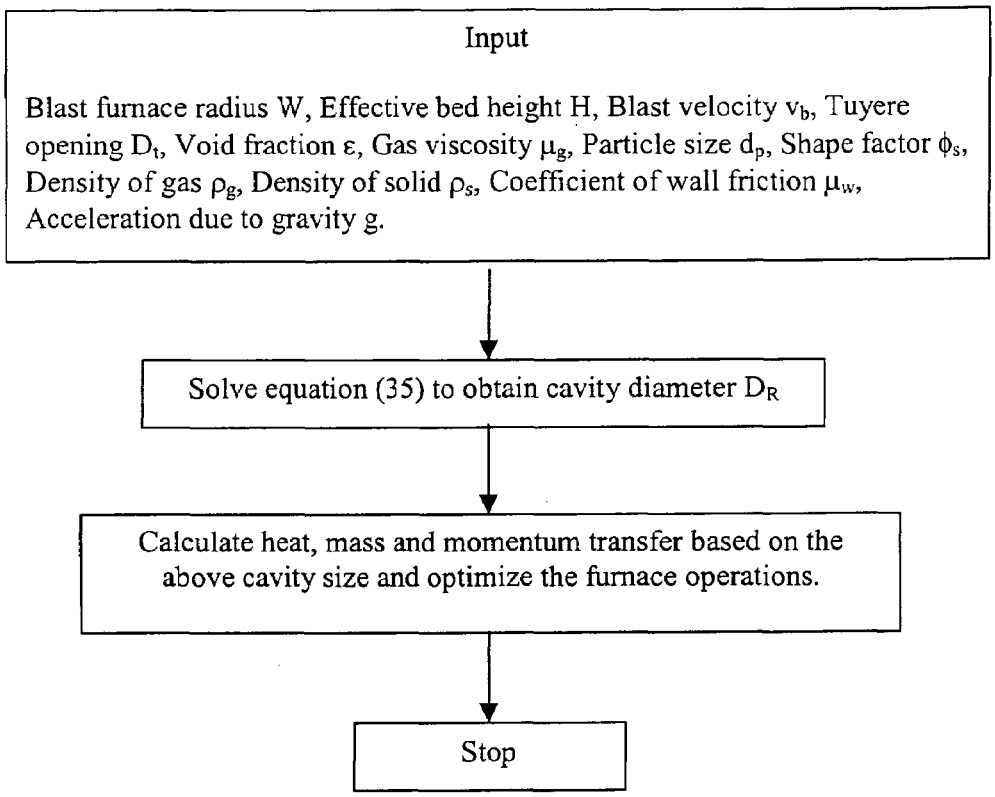

Figure 23: Determination of Maximum Velocity/Cavity Size in a Spouted Bed Above Which Spout Will Form / Or Condition of Instability In Packed Bed Based on Mathematical Model
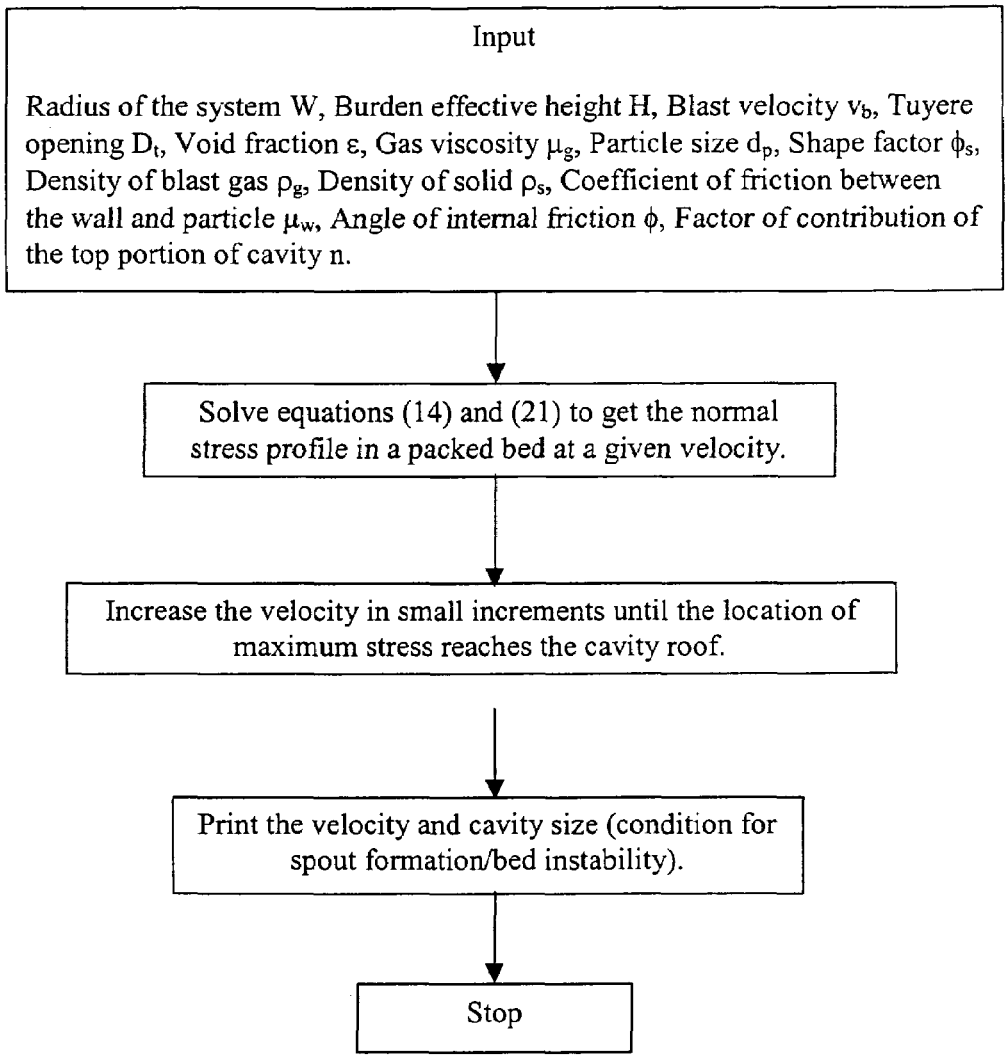

Figure 24: Flow chart for determining cavity/raceway size in packed bed like ironmaking & lead blast furnaces, corex, cupola, etc.
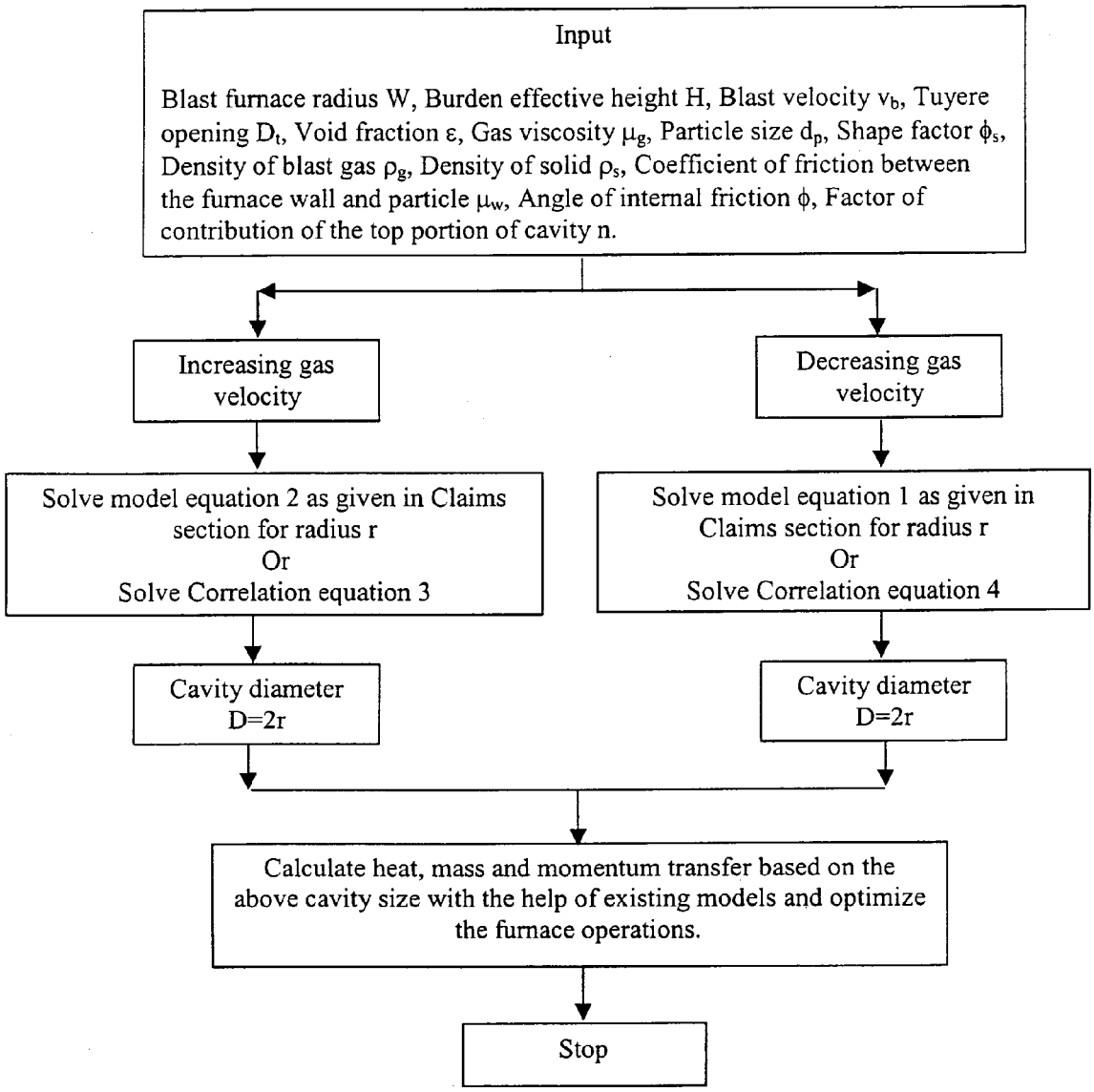

PREDICTION OF CAVITY SIZE IN THE PACKED BED SYSTEMS USING NEW CORRELATIONS AND MATHEMATICAL MODEL

FIELD OF THE INVENTION

The present invention relates to prediction of cavity size in the packed bed systems using new correlations and mathematical model. Simplified equations, based on analytical solution of one-dimensional mathematical model, have been developed along with the cavity correlations to describe the cavity size and hysteresis. The proposed correlations and mathematical model give a universal approach to predict the cavity size which is applicable to any packed bed systems like blast furnaces, cupola, Corex, catalytic regenerator, etc. and is able to represent, in a good way, the data of other researchers provided the frictional properties of the particulate are known. Developed correlations and model can be used directly to optimize the above mentioned and other related processes.

PRIOR ART

On Packed Bed: In the packed bed, contact forces between the particles and wall-particle have been considered widely in explaining its behavior in various conditions. Reference may be made to F. J. Doyle III, R. Jackson and J. C. Ginestra, "The phenomenon of pinning in an annular moving bed reactor with crossflow of gas", Chem. Eng Sci, 41(6) 1986 1485, wherein they have studied moving bed of cross flow theoretically in order to study the pinning effect in catalytic reformer. Their analysis is based on force balance approach considering the gas drag, stresses and gravity forces. The drawbacks of their simplified model, which they had presented, are (i) it is based on arbitrary assumption of the radial variation of the stress in the moving beds. Due to this reason their numerical values are greater than limited experimental values by a factor of two. (ii) They had assumed the shear stress at the wall of the moving bed reactor to act in the downward direction. (iii) The analysis was confined to the growth of cavity till the solid flow ceases in moving bed.

Reference may be made to V. B. Apte, T. F. Wall and J. S. Truelove: AIChEJ, 1990, vol. 36 (3), pp. 461–468, wherein they have analysed the stress distribution above a cavity formed by an upward gas blast from the bottom of a two-dimensional packed bed. They wrote one dimensional elemental force balance, along the streamline coincident with the tuyere axis, between the pressure, bed weight and frictional forces. The drawbacks o their model are (i) they had assumed that frictional stresses always act in the upward direction. (ii) They were unable to show any hysteresis results. (iii) They neglected any acceleration effect due to slowing down of the gas and (iv) did not predict the cavity size. Mainly their study was concentrated on the stress distribution in the packed bed under increasing velocity.

Reference may be made to J. F. MacDonald, and J. Bridgwater, Chem. Eng. Sci., 1997, vol. 52 (5), pp. 677–691, wherein they have studied the phenomenon of void formation in stationary and moving beds of solids and unified the behaviour using dimensional analysis. The drawback of their correlation is that they recognised the importance of frictional forces in cross flow but were unable to include it in their dimensional analysis.

On (Ironmaking, Lead, Corex, etc.) Blast Furnaces: In the blast furnace, gas is introduced laterally at a high velocity through a pipe, called tuyere, in the packed bed of coke. This creates a cavity in front of the tuyere called raceway. Coke is burnt in this zone to supply heat to the process. Therefore, coke particles get consumed in this region and they are replenished by fresh coke particles from the top of the raceway. So the whole burden descends in the downward direction. The size and shape of the raceway affects the aerodynamics of the furnace and thus affects the overall heat and mass transfer. Due to this reason, raceway has been studied extensively both theoretically and experimentally. In case of blast furnace, many authors have presented raceway correlations to predict the raceway size which are listed in Table 1. Most of these correlations are based on cold model study and some of them are based on hot model and plant data study.

References may be made to J. D. Lister, G. S. Gupta, V. R. Rudolph and E. T. White: CHEMECA'91 Conf., 1991 Newcastle, Australia, vol. 1, 476 and S. Sarkar, G. S. Gupta, J. D. Litster, V. Rudolph, E. T. White and S. K. Choudhary: Metall Trans., 2003, 34B (2), 183–191, wherein they have that none of these correlations predicts the raceway size in industrial conditions reasonably and they also differ to each other. It is observed that all the experimental correlations have been based on various forms of Froude number. The raceway size has been institutively correlated with this number along with some other parameters such as height of the bed, width of the model and tuyere opening.

References may be made to J. F. Elliott, R. A. Bachanan and J. B. Wagstaff: Trans. AIME, 1952, vol. 194, pp; 709–717. J. Taylor, G. Lonie and R. Hay: JISI, 1957, vol. 187, p330; J. B. Wagstaff and W. H. Holman: Trans. AIME, March 1957, pp. 370–376. M; Hatano, B. Hiraoka, M. Fukuda and T. Masuike: Int. ISIJ, 1977, 17, pp. 102–109; M. Nakamura, T. Sugiyama, T. Uno, Y. Hara and S. Kondo: Tetsu-to-Hagane, 1977, vol 63, pp. 28, wherein one can see that these correlations (see Table I) are not evolved based on a systematic study i.e. by applying dimensional analysis and finding the relevant groups.

On the other hand, theoretical correlations have been obtained by simplifying the actual theoretical equations logically by P. J. Flint and J. M. Burgess: Metall. Trans., 1992, vol. 23B, pp. 267–283 and J. Szekely and J. J. Poveromo: Metall. Trans., 1975, vol. 6B, pp. 119–130. These correlations are more systematic. Also, all the empirical correlations, for the two and three-dimensional models, have been obtained for the velocity increasing case.

It must be mentioned here that one can get two raceways size at the same gas velocity depending on whether the measurement is made in the increasing or decreasing gas velocity. This phenomena is called raceway hysteresis. References may be made to J. D. Lister et al. 1991 and S. Sarkar et al. 2003, wherein hysteresis phenomenoa has been described in detail and has been reported that the decreasing velocity correlation is more relevant to blast furnace.

Since the raceway size in the increasing and decreasing velocity case vary by approximately a factor of 4, the raceway size can affect considerably the predictions of heat, mass and momentum transfer in the blast furnace. At this juncture something about the raceway hysteresis should be mentioned because the background of the correlations/mathematical model developed in this study is based upon this phenomena. Reference may be made to S. Sarkar et al. 2003, wherein they have explained raceway hysteresis phenom enon in details and have proposed that raceway hysteresis can be represented by the following equation, based on their experimental results.

$$\text{Pressure Force}-\text{Bed Weight}\pm\text{Frictional Forces (Stresses)}=0 \quad (1)$$

The physical interpretation of this equation is that when the raceway is expanding, the particles near and above the raceway are being pushed in the upward direction. So the frictional stresses will tend to oppose this motion of the particles and hence act in the downward direction and is fully mobilized. When we start to decrease the blast velocity from a maximum value, the particles above the raceway are trying to fall down. So the frictional forces act against this movement and start increasing in magnitude in the upward direction progressively. Once the frictional stresses acting in the upward direction become fully mobilized, further reduction in blast velocity results in decrease in the raceway penetration. A positive sign in the equation (1) in the frictional forces term indicates cavity wall friction acting upwards (for velocity decreasing) and a negative sign indicates cavity wall friction acting downwards (for velocity increasing). Pressure force always acts in the upward direction and bed weight always acts in the downward direction.

OBJECTS OF THE PRESENT INVENTION

The main object of the present invention is to provide a method and a system for prediction of cavity size in the packed beds using new correlations and/or mathematical model which obviates the drawbacks as detailed above.

Statement of Invention:

Accordingly the present invention provides a method and a system for prediction of cavity size in the packed beds using new correlations and mathematical model which comprises the development of two correlations, one each for increasing and decreasing gas velocity respectively based on π-theorem for two-dimensional cold model experiments having the variables like bed height, tuyere opening, void fraction, frictional and physical properties of various materials, gas flow rates and width of the model as well as it comprises the development of one dimensional mathematical model based upon a force balance approach (as discussed in prior art) and then solving the developed equations analytically for pressure force, frictional force and bed weight to describe the cavity hysteresis and to predict the cavity/raceway size & minimum spouting velocity/instability in packed beds and later on to compare the correlations and model results with experiments and published/plant data on cavity size.

In an embodiment of the present invention it clarifies the direction of frictional forces and gives a logical explanation of it to describe the hysteresis in the packed beds.

In another embodiment of the present invention it also brings out that decreasing velocity data are relevant to operating blast furnaces.

In yet another embodiment of the present invention it gives, through math model, the maximum operating gas velocity in a packed bed beyond which it will become unstable.

DETAILED DESCRIPTION OF THE INVENTION

Accordingly, the present invention provides a computer based method for determining the cavity size in packed bed systems using correlation or mathematical model, said method comprising the steps of:

(a) obtaining data related to material properties of the packed bed system;

(b) calculating the cavity radius for both increasing gas velocity and decreasing gas velocity using mathematical model incorporating the stresses/frictional forces as:

$$2nR^2 - 2nHR + \frac{p\eta\beta v_b^2 D_T^2}{2\pi^2 M}\left\{\ln\frac{W}{2\pi} - \ln\left(R - \frac{D_T}{2\pi}\right\} + \left(\frac{2r_o}{M\pi}(\alpha + \beta v_H)v_H(H - r_o) - \frac{F_{wd}}{M\pi}\right) = 0 \quad (29)$$

and $$2nR^2 - 2nHR + \frac{p\eta\beta v_b^2 D_T^2}{2\pi^2 M}\left\{\ln\frac{W}{2\pi} - \ln\left(R - \frac{D_T}{2\pi}\right\} + \left(\frac{2r_o}{M\pi}(\alpha + \beta v_H)v_H(H - r_o) + \frac{F_{wd}}{M\pi}\right) = 0 \quad (28)$$

respectively; or calculating the cavity radius for both increasing gas velocity and decreasing gas velocity using mathematical equations based on correlation as:

$$\frac{D_r}{D_T} = 4.2\left(\frac{\rho_g v_b^2 D_T}{\rho_{eff} g d_{eff} W}\right)^{0.6}\left(\frac{D_T}{H}\right)^{-0.12}(\mu_w)^{-0.24} \quad (36)$$

$$\frac{D_r}{D_T} = 164\left(\frac{\rho_g v_b^2 D_T^2}{\rho_{eff} g d_{eff} HW}\right)^{0.80}(\mu_w)^{-0.25} \quad (33)$$

respectively, and (c) calculating the cavity size using the cavity radius obtained in step (b).

In an embodiment of the present invention, the data related to material properties of the packed bed comprise bed height, tuyere opening, void fraction, wall-particle friction coefficient, inter-particle frictional coefficient, gas velocity, model width and particle shape factor.

In another embodiment of the present invention, the data related to the material properties of the packed bed include experimental data already obtained or on-line data.

In yet another embodiment of the present invention, the frictional force ($F_{wd}$) in equations 28 and 29 is given by:

$$F_{wtd} = -\frac{4n\pi\mu_w KhpM}{3\left(1 - \frac{\mu_W K}{n\pi}\right)}\left\{\left(r_o - \frac{D_T}{2\pi}\right)^3 - \left(R - \frac{D_T}{2\pi}\right)^3\right\} - 4pn\mu_w K\frac{\beta v_b^2 D_T^2}{4\pi\left(1 + \frac{\mu_W K}{n\pi}\right)}(r_o - R) + \frac{4n\pi\mu_w K\left(\frac{W}{2\pi}\right)^{1-\frac{\mu_W K}{n\pi}} hpM}{\left(1 - \frac{\mu_w K}{n\pi}\right)\left(2 + \frac{\mu_w K}{n\pi}\right)}\left\{\left(r_o - \frac{D_T}{2\pi}\right)^{2+\frac{\mu_W K}{n\pi}} - \left(R - \frac{D_T}{2\pi}\right)^{2+\frac{\mu_W K}{n\pi}}\right\} + 4pn\mu_w K\left(\frac{\beta v_b^2 D_T^2}{4\pi}\right)\times\frac{1}{\left(\frac{W}{2\pi}\right)^{1+\frac{\mu_W K}{n\pi}}\left(1 + \frac{\mu_w K}{n\pi}\right)\left(2 + \frac{\mu_w K}{n\pi}\right)}$$

-continued $$\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}+\frac{2pWn\pi}{\left(2+\frac{\mu_w K}{n\pi}\right)}$$

$$\left(\frac{W}{2\pi}\right)^{-\frac{\mu_W K}{n\pi}}\times\left\{M-\frac{\alpha v_b D_T}{W}-\frac{\beta v_b^2 D_T^2}{W^2}\right\}\left\{1-e^{-C\left(H-\frac{W+D_T}{2\pi}\right)}\right\}$$

$$\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}+W\left(\frac{W+D_T}{\pi}\right)$$

$$\left\{M-\frac{\alpha v_b D_T}{W}-\frac{\beta v_b^2 D_T^2}{W^2}\right\}\left[(H-r_o)+\frac{\{e^{-C\{H-r_o\}}-1\}}{C}\right]$$

In still another embodiment of the present invention, wherein to determine the cavity radius using increasing velocity correlation as given by equation 33 was developed using π-theorem to get the important dimensionless numbers $$\frac{D_r}{D_T}=164\left(\frac{\rho_g v_b^2 D_T^2}{\rho_{eff}\, g\, d_{eff}\, HW}\right)^{0.80}(\mu_w)^{-0.25}$$

where, symbols are Blast furnace radius W, Effective bed height H, Blast velocity $v_b$, Tuyere opening $D_t$, Void fraction $\epsilon$, Gas viscosity $\mu_g$. Particle size $d_p$, Shape factor $\phi_s$, Density of gas $\rho_g$, Density of solid $\rho_s$, Coefficient of wall friction $\mu_w$, acceleration due to gravity g, the effective diameter of the particle is given by $d_{eff}=d_p\phi_s$, effective density of the bed is given by $\rho_{eff}=\epsilon\rho_g+(1-\epsilon)\rho_s$, wall-particle frictional coefficient is given by $\mu_w=\tan\phi_w$, where, $\phi_w$ is an angle of friction between the wall and particle $D_r$ is cavity diameter and all units are in SI.

In one more embodiment of the present invention, wherein to determine the cavity radius using decreasing velocity correlation as given by equation 36 was developed using π-theorem to get the important dimensionless numbers $$\frac{D_r}{D_T}=4.2\left(\frac{\rho_g v_b^2 D_T}{\rho_{eff}\, g\, d_{eff}\, W}\right)^{0.6}\left(\frac{D_T}{H}\right)^{-0.12}(\mu_w)^{-0.24}$$

where, symbols are Blast furnace radius W, Effective bed height H, Blast velocity $v_b$, Tuyere opening $D_t$, Void fraction $\epsilon$, Gas viscosity $\mu_g$, Particle size $d_p$, Shape factor $\phi_s$, Density of gas $\rho_g$, Density of solid $\rho_s$, Coefficient of wall friction $\mu_w$, Acceleration due to gravity g, the effective diameter of the particle is given by $d_{eff}=d_p\phi_s$, effective density of the bed is given by $\rho_{eff}=\epsilon\rho_g+(1-\epsilon)\rho_s$, wall-particle frictional coefficient is given by $\mu_w=\tan\phi_w$, where, $\phi_w$ is an angle of friction between the wall and particle $D_r$ is cavity diameter and all units are in SI.

In one another embodiment of the present invention, wherein the packed bed systems include blast furnaces, cupola, corex, catalytic regenerator.

It is important in any gas-solid process to achieve a uniform gas and solid distribution which determines its performance. Packed, spouted and fluidized beds fall under these categories and are widely used in industries. A common feature of all these beds is that they all show hysteresis. FIG. 1 shows a cavity hysteresis plot between the cavity diameter and gas velocity which clearly shows the presence of hysteresis. It is evident from the figure that cavity size increased with increasing gas velocity. When the gas velocity was decreased from the maximum value (A), there was initially almost no change in the cavity size. However, when a critical velocity was reached (B), the cavity size began decreasing with decreasing velocity, but was always larger than that for the same velocity achieved in increasing velocity. This is the cavity hysteresis phenomenon. The cavity hysteresis found in the packed beds is similar to hysteresis found in fluidization beds.

Here we are presenting a one-dimensional theoretical model based on equation (1) to predict the cavity size and to describe the mechanism of hysteresis in the packed bed. Also we are presenting new cavity/raceway size correlations using π-theorem. The various terms in the equation (1) are expressed in their mathematical form below.

Model Formulation

Let us consider a two-dimensional packed bed of solids of height H and width W as shown in FIG. 2. The gas was injected laterally at a particular blast velocity $v_b$ through a slot type nozzle of opening $D_T$, creating a void of equivalent radius R in front of it. Let ρ and μ be the density and viscosity of gas respectively. $d_p$ is the particle diameter and $\epsilon$ is the void fraction of the bed. D. Akamatsu, M. Hatano and M. Takeuchi, Tetsu-to-Hagane 58 (1972) 20, had measured the pressure inside the cavity and had found that that the pressure distribution was relatively uniform. Therefore, it is reasonable to assume that the gas flows radially from the center of the cavity into the surrounding packed bed with the velocity varying along concentric circles. Based on several other experimental and theoretical studied (Szekely & Poveromo (1975), Flint & Burgess (1992), V. B. Apte, T. F. Wall and J. S. Truelove, Gas Flows in Cavities Formed by High Velocity Jets in a Two-Dimensional Packed Bed, Chem Eng Res Des 66 (1988) 357, and, M. Hatano, K. Kurita and T. Tanaka, Ironmaking Proc. Iron Steel Soc 42 (1983) 577), isobaric condition inside the cavity has been assumed. The velocity of gas, which is moving upwards, varies with the r-direction (distance from the center of cavity) but does not vary in the angular direction.

Pressure exerted by the gas: It has been reported (Flint & Burgess, 1992 and Apte et. al., 1990) that gas velocity becomes almost constant at the exit bed velocity after some distance say $r=r_o$ from the cavity center. The corresponding velocity at this distance is $v=v_H$ (see FIG. 2). Then, equating the mass flow rate of gas at the nozzle and at a distance $r_o$ from the center of the cavity, we get $$\rho v_b D_T=\rho(2\pi r_o-D_T)v_H \text{ Or, } v_H=v_b D_T/(2\pi r_o-D_T) \quad (2)$$

Also, equating the mass flow rate of blast at the nozzle and at the bed surface, one gets $$\rho v_b D_T=\rho W v_H \text{ Or, } v_H=v_b D_T/W \quad (3)$$

From (2) and (3), one obtains $$r_o=(W+D_T)/2\pi \quad (4)$$

After a distance $r_o$ from the cavity center, the velocity of the gas will be constant. This observation has been confirmed computationally by Flint & Burgess, 1992. Analysis of the experimental data of Apte et al., 1990, also verifies the validity of equations (3) & (4).

Let v(r) be the gas velocity at a distance r from the center of the cavity. Then on equating the mass flow rate at the nozzle opening and at a distance r from the center of the cavity, $$\rho(2\pi r-D_T)v(r)=\rho v_b D_T \text{ Or, } v(r)=v_b D_T/(2\pi r-D_T) \quad (5)$$

Based on the above equations, the modeled velocity profile may be written as $$v(r)=v_b D_T/(2\pi r-D_T), r<r_o=v_{H,r\geq ro} \quad (6)$$

Therefore, the velocity of the gas, which is moving upwards, varies inversely with distance up to a distance of $r_o$ from the center of the cavity (radial region) and then remains constant beyond this (Cartesian region).

For drag force in fluidized bed, many researchers have widely used Richardson-Zaki correlation. Similarly, in packed bed the force per unit volume exerted by the gas on solid is given from well-known Ergun's equation $$-\frac{\Delta p}{\Delta r}=\alpha v(r)+\beta v^2(r) \quad (7)$$

$$\text{where, } \alpha=\frac{150(1-\varepsilon)^2\mu}{\varepsilon^3\phi_s^2 d_p^2} \text{ and, } \beta=\frac{1.75(1-\varepsilon)\rho}{\varepsilon^3\phi_s d_p}$$

$\phi_s$ is the shape factor of particle. In practice, the gas velocity in the radial region is high. At these high velocities the viscous term is negligible compared to the inertial term i.e. $\alpha v(r)<<\beta v^2(r)$. Therefore, the force exerted by the gas on the solids is given by $$F_1=\int_R^{r_o}-\frac{\Delta p}{\Delta r}(2\pi r-D_T)dr=\int_R^{r_o}\beta v^2(r)(2\pi r-D_T)dr \quad (8)$$

$$\text{Or, } F_1=\frac{\beta v_b^2 D_T^2}{2\pi}\left\{\ln\frac{W}{2\pi}-\ln\left(R-\frac{D_T}{2\pi}\right)\right\}$$

Similarly, the force exerted by the gas in the Cartesian region would be $$F_2=\int_{r_o}^{z}-\frac{\partial p}{\partial z}\left(\frac{W+D_T}{\pi}\right)dz \text{ where, } -\partial p/\partial z=\alpha v_H+\beta v_H^2 \quad (9)$$

And, $(W+D_T)/\pi=(2\pi_o)$ is the diameter of the largest circle, in the varying velocity region, through which the gas flows out radially and enters into the Cartesian region as shown in FIG. 4. z is the variable height of the packed bed from the tuyere level. After integrating the equation (9), one gets $$F_2=(\alpha+\beta v_H)v_H[(W+D_T)/\pi][H-(W+D_T)/2\pi]=(\alpha+\beta v_H)v_H(2r_o)(H-r_o) \quad (10)$$

Therefore, the total force exerted by the gas (either in increasing or decreasing velocity) on the solids above cavity can be given by $$F_{pr\text{-}f}=F_1+F_2$$

Determination of Frictional Force in the Cartesian Region (Decreasing Velocity): In decreasing velocity, the particle-wall frictional force acts in the upward direction as explained earlier and is shown in FIG. 3 along with other forces in which z-axis is along the upward direction from the tuyere level or from the center of the cavity. It is assumed that the normal stress ($\sigma_z$), acting in the upward direction, is constant at any distance z from the bed surface. dz is the thickness of the slice over which the elemental balance is done. Let $\sigma_z+d\sigma_z$ be the reaction stress at distance z+dz acting in the downward direction and $\tau_w$ be the particle-wall frictional stress. M is the bed weight per unit volume. Equating the forces acting on the element, we get:

$$(\sigma_z+d\sigma_z)\times W\times 1+M\times W\times dz\times 1=\sigma_z\times W\times 1+2\tau_w\times dz\times 1+dP\times W\times 1 \quad (11)$$

Factor 2 in the second term on the right side is due to $\tau_w$ acting on both sides of the wall. dP is the force per unit area exerted by gas over the element=$(-\partial p/\partial z)$ dz.

Following Janssen approach (H. A. Janssen, Versuche uber getreidedruck in solozellen. Ver. Deutsch. Ing. Zeit. 39 (1895) 1045), it is assumed that the vertical stress ($\sigma_z$) and horizontal stress ($\sigma_x$) are the principal stresses. Therefore, particle-wall frictional stress can be written as $\tau_w=\mu_w K\sigma_z$. Where, $K=((1-\sin\phi)/(1+\sin\phi))$ is the lateral pressure coefficient K and $\phi$ is the angle of internal friction. $\mu_w$ is the coefficient of friction between the bed walls and the particle. Substituting the value of $\tau_w$ in the equation (11) and after some simplification one gets $$\frac{d\sigma_z}{dz}-\frac{2\mu_w K\sigma_z}{W}=-M-\frac{\partial p}{\partial z} \quad (12)$$

The solution of equation (12), using the boundary condition, at z=H, $\sigma_z=0$, would be $$\sigma_z=\frac{M}{C}\left\{1-e^{C(z-H)}\right\}-e^{Cz}\int_H^z\frac{\partial p}{\partial z}e^{-Cz}dz \quad (13)$$

where, $C=2\mu_w K/W$, is the bed support factor. The first term on the right hand side of equation (13) is the effective bed weight, while the second term represents the upward gas pressure drag. For a uniform gas flow in the bed i.e. a constant $-\partial p/\partial z$ ($=\alpha v_H+\beta v_H^2$), equation (13) reduces to (after substituting the value of $v_H$ from the equation (3))

$$\sigma_z=\frac{1}{C}\left\{M-\frac{\alpha v_b D_T}{W}-\frac{\beta v_b^2 D_T^2}{W^2}\right\}\{1-e^{C(z-H)}\} \quad (14)$$

For a no gas flow situation, i.e. a static bed, the equation (14) reduces to $$\sigma_z=\frac{M}{C}\{1-e^{C(z-H)}\} \quad (15)$$

This is a classical Jansen's equation, assuming a constant $\sigma_z$ over any horizontal cross section. For deep beds as $(H-z)\rightarrow\infty$, the above equation becomes $\sigma_z=M/C$.

C is a function of W, $\mu_w$ and K and hence is a measure of the particle-wall frictional support. Larger C implies a larger particle-wall frictional support and hence a smaller effective bed weight. Also C is inversely proportional to the width of the model. Larger the width of the model, lower will be the value of C. From equation (15), as $\lim_{c\rightarrow 0}\sigma_z=M(H-z)$, implying that for C=0, the bed weight would be transmitted as an equivalent hydrostatic head.

It is necessary to determine the particle-wall frictional force acting over this region in the Cartesian system. The particle-wall frictional force $F_{wd2}$ acting in the upward direction in the region lying over a distance $2r_o$, in the constant velocity region is obtained by multiplying particle-wall frictional stress $\tau_w$ by area and integrating it from $z=r_o$ to $z=H$.

$$F_{wd2} = \int_{r_o}^{H} \tau_w \times 2\left(\frac{W+D_T}{\pi}\right) dz = \int_{r_o}^{H} \mu_w K \sigma_z \times 2\left(\frac{W+D_T}{\pi}\right) dz = W\left(\frac{W+D_T}{\pi}\right)\left\{M - \frac{\alpha v_b D_T}{W} - \frac{\beta v_b^2 D_T^2}{W^2}\right\}\left[(H-r_o) + \frac{\{e^{-C(H-r_o)}\}-1}{C}\right] \tag{16}$$

Frictional Forces in the Radial Region: Like the Cartesian region, the radial system for elemental balance is shown in FIG. 4. Resolving all the forces along the radial direction and doing a force balance over the top portion of the circular element, one gets $$\sigma_r\{n(2\pi r-D_T)\}+2\tau_W\times dr\times 1+dP\times\{n(2\pi r-D_T)\}\times 1=(\sigma_r+d\sigma_r)\{n(2\pi(r+dr)-D_T)\}+h\times M\{n(2\pi r-D_T)\}\times dr\times 1 \tag{17}$$

where, dr is the thickness of the circular section over which the elemental balance is carried out. $\sigma_r$ is the radial stress at radius r and $\sigma_r+d\sigma_r$ is the reaction stress at radius r+dr. $\tau_w$ is the particle wall frictional stress acting in the upward direction. n is the factor of contribution of top portion of the cavity to the total cavity area and h is the factor arising due to resolving the vertical force along the radial direction, so $$h = \int_{-n\pi}^{+n\pi} \cos\alpha\, d\alpha$$

$$dP = -\frac{\partial p}{\partial r} \times dr \text{ and } -\frac{\partial p}{\partial r} = \beta v^2(r) = \frac{\beta v_b^2 D_T^2}{(2\pi r - D_T)^2} \tag{18}$$

Assuming that $\sigma_r$ and $\sigma_\theta$ are the principal stresses, then $$\tau_w=\mu_w\sigma_\theta=\mu_w K\sigma_r \tag{19}$$

After substituting the value of $\tau_w$ and dP in the equation (17) and integrating it, one gets $$\sigma_r\left(r-\frac{D_r}{2\pi}\right)^{-\frac{\mu_w K}{n\pi}} = -\frac{hM\left(r-\frac{D_T}{2\pi}\right)^{1-\frac{\mu_w K}{n\pi}}}{1-\frac{\mu_w K}{n\pi}} - \int \frac{\partial p}{\partial r}\left(r-\frac{D_T}{2\pi}\right)^{-\frac{\mu_w K}{n\pi}} dr + A \tag{20}$$

Close to the cavity region, where the velocity is very high, the second term in the above equation becomes significantly high leading to a drop in stress. A, the constant of integration, can be calculated using the boundary condition at the interface of the radial and cartesian systems i.e. at $r=r_o$, $\sigma_r=\sigma_2$. Finally, equation (20) can be written as $$\sigma_r = -\frac{hM\left(r-\frac{D_T}{2\pi}\right)}{1-\frac{\mu_w K}{n\pi}} - \frac{\beta v_b^2 D_T^2}{4\pi^2\left(1+\frac{\mu_w K}{n\pi}\right)\left(r-\frac{D_T}{2\pi}\right)} + \frac{hM\left(\frac{W}{2\pi}\right)^{1-\frac{\mu_w K}{n\pi}}\left(r-\frac{D_T}{2\pi}\right)^{\frac{\mu_w K}{n\pi}}}{1-\frac{\mu_w K}{n\pi}} + \frac{\beta v_b^2 D_T^2\left(r-\frac{D_T}{2\pi}\right)^{\frac{\mu_W K}{n\pi}}}{4\pi^2\left(\frac{W}{2\pi}\right)^{1+\frac{\mu_W K}{n\pi}}\left(1+\frac{\mu_w K}{n\pi}\right)} + \frac{1}{C}\left\{M - \frac{\alpha v_b D_T}{W} - \frac{\beta v_b^2 D_T^2}{W^2}\right\}\{1-e^{-C(H-r_o)}\}\left(\frac{r-\frac{D_T}{2\pi}}{\frac{W}{2\pi}}\right)^{\frac{\mu_W K}{n\pi}} \tag{21}$$

In the above equation, the bed weight (M) containing terms when added give the effective bed weight and the blast velocity ($v_b$) containing terms when added give the effective upward gas pressure drag. The wall frictional force can be obtained by multiplying $\tau_w$, resolved along the vertical direction, with the area and integrating from r=R to $r=r_o$ as given below.

$$F_{wtd1} = 2p\int_R^{r_o} \tau_w\{n(2\pi r) - D_T\}\, dr = 2p\int_R^{r_o} \mu_w K\sigma_r\{n(2\pi r) - D_T\}\, dr \tag{22}$$

where, p=h=factor obtained by resolving the radial force along vertically upward direction. On integration, equation (22) can be written as $$F_{wtd1} = -\frac{4n\pi\mu_w KhpM}{3\left(1-\frac{\mu_W K}{n\pi}\right)}\left\{\left(r_o-\frac{D_T}{2\pi}\right)^3 - \left(R-\frac{D_T}{2\pi}\right)^3\right\} - 4pn\mu_w K - \frac{\beta v_b^2 D_T^2}{4\pi\left(1+\frac{\mu_W K}{n\pi}\right)}(r_o - R) + \frac{4n\pi\mu_w K\left(\frac{W}{2\pi}\right)^{1-\frac{\mu_w K}{n\pi}} hpM}{\left(1-\frac{\mu_w K}{n\pi}\right)\left(2+\frac{\mu_w K}{n\pi}\right)}\left\{\left(r_o-\frac{D_T}{2\pi}\right)^{2+\frac{\mu_w K}{n\pi}} - \left(R-\frac{D_T}{2\pi}\right)^{2+\frac{\mu_w K}{n\pi}}\right\} + 4pn\mu_w K\left(\frac{\beta v_b^2 D_T^2}{4\pi}\right)\times \frac{1}{\left(\frac{W}{2\pi}\right)^{1+\frac{\mu_W K}{n\pi}}\left(1+\frac{\mu_w K}{n\pi}\right)\left(2+\frac{\mu_w K}{n\pi}\right)}\left\{\left(r_o-\frac{D_T}{2\pi}\right)^{2+\frac{\mu_W K}{n\pi}} - \left(R-\frac{D_T}{2\pi}\right)^{2+\frac{\mu_W K}{n\pi}}\right\} + \tag{23}$$

-continued $$\frac{2pWn\pi}{\left(2+\frac{\mu_w K}{n\pi}\right)}\left(\frac{W}{2\pi}\right)^{-\frac{\mu_W K}{n\pi}}\times\left\{M-\frac{\alpha v_b D_T}{W}-\frac{\beta v_b^2 D_T^2}{W^2}\right\}$$

$$\left\{1-e^{-C\left(H-\frac{W+D_T}{2\pi}\right)}\right\}$$

$$\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}$$

Elemental Force Balance During Increasing Velocity:

It can be done in a similar way as it has been done for the decreasing velocity case as reported in S. Rajneesh, M. E. (Int.) Thesis, Indian Institute of Science, Bangalore, September 2000 and in CSIR Report No. 22(285)/99/EMR-II.

Force Balance Over Top of the Cavity (for Decreasing Velocity)

From equation (8), force exerted by the gas above the top of the cavity in varying velocity region in the vertically upward direction (after resolving it) is given by $$F_{1a}=\frac{pn\beta v_b^2 D_T^2}{2\pi}\left\{\ln\frac{W}{2}-\ln\left(R-\frac{D_T}{2\pi}\right)\right\} \tag{24}$$

Therefore, the total force exerted by gas on solid in the upward direction is $$\begin{aligned}F_{pr-f}&=F_{1a}+F_2\\&=\frac{pn\beta v_b^2 D_T^2}{2\pi}\left\{\ln\frac{W}{2\pi}-\ln\left(R-\frac{D_T}{2\pi}\right)\right\}+\\&\quad(\alpha+\beta v_H)(H-r_o)v_H(2r_o)\end{aligned} \tag{25}$$

Similarly, the total particle-wall frictional force acting in the upward direction is $$F_{wd}=F_{wd1}+F_{wd2} \tag{26}$$

where, $F_{wtd1}$ and $F_{wd2}$ are given by the equations (23) and (16) respectively.

It is assumed that bed weight is transmitted hydrostatically over the cavity roof. For simplification it has been assumed that the contribution of the bed weight from the sides to the cavity formation is negligible. Therefore, bed weight at the top of the cavity roof is $$=\text{Bed weight/area}\times\text{Area of the top portion the cavity}=M(H-R)\times n(2\pi R)\times 1 \tag{27}$$

Wherein "n" is the factor of contribution of the top portion of the cavity to the cavity area.

After substituting all forces (equations 25, 26 and 27) in the equation (1) and after some simplification one can write the equation in terms of cavity radius, R.

$$2nR^2-2nHR+\frac{pn\beta v_b^2 D_T^2}{2\pi^2 M}\left\{\ln\frac{W}{2\pi}-\ln\left(R-\frac{D_T}{2\pi}\right)\right\}+\left(\frac{2r_o}{M\pi}(\alpha+\beta v_H)v_H(H-r_o)+\frac{F_{wd}}{M\pi}\right)=0 \tag{28}$$

Solving equation (28) for R numerically, gives the cavity radius in the velocity decreasing case and thus the cavity diameter $D_r$=2R.

Similarly, one can establish the force balance over the cavity in the case of increasing velocity and can obtained the cavity diameter as explained above.

$$2nR^2-2nHR+\frac{pn\beta v_b^2 D_T^2}{2\pi^2 M}\left\{\ln\frac{W}{2\pi}-\ln\left(R-\frac{D_T}{2\pi}\right)\right\}+\left(\frac{2r_o}{M\pi}(\alpha+\beta v_H)v_H(H-r_o)-\frac{F_{wd}}{M\pi}\right)=0 \tag{29}$$

Raceway/Cavity Size Correlations:

Velocity Increasing Case (Using Buckingham π-Theorem)

The raceway is formed due to a balance between the pressure force exerted by the gas, bed weight and the frictional forces as described by the force balance equation (1). The pressure force exerted by the gas comprises the inertial and viscous force. The inertial force exerted by the gas depends on the blast velocity ($v_b$, m/s), density of the gas ($\rho_g$, kg/m$^3$) and the tuyere opening ($D_T$, m). The viscous force exerted by the gas depends on the viscosity (μ, Pa·s) of the gas and the particle diameter ($d_p$, m). The bed weight exerted by the packing depends on the density of the solid ($\rho_s$, kg/m$^3$), acceleration due to gravity (g, m/sec$^2$), height of the bed (H, m) and void fraction of the bed. The frictional forces (or stresses) depend on the internal and wall angle of friction and this causes the introduction of the wall-particle frictional coefficient $\mu_w$ and v, the inter-particle frictional coefficient. Finally, the width of the bed W has been taken since it has been varied during the experiments as it affects the raceway penetration. In other words, the raceway diameter ($D_r$, m) in a packed bed is a function of the property of material used for packing, property of the gas injected through the tuyere, the geometrical parameters and the frictional parameters i.e.

The effective diameter of the particle is given by $d_{eff}=d_p sh$, where $d_p$=diameter of the particle and sh=shape factor of the particle. Effective density of the bed is given by $\rho_{eff}=\epsilon\rho_g+(1-\epsilon)\rho_s$. Wall-particle frictional coefficient is given by $\mu_w=\tan\phi_w$ and inter-particle frictional coefficient is given by v=tan θ. Where, ϕ and $\phi_w$ are an internal angle of friction between the particles and angle of friction between the wall and particle respectively.

$$D_r=f(\rho_{eff},\rho_g,v_b,g,d_{eff},\mu,D_T,H,W,\mu_w,v) \tag{30}$$

Since the total number of variables is 12 and the number of independent variables in terms of which the variables can be expressed is 3, the number of dimensionless groups that will be obtained from Buckingham π-theorem is 9. Using π-theorem, the correlation for the raceway diameter was obtained as:

$$\frac{D_r}{D_T}=k\left(\frac{\rho_g}{\rho_{eff}}\right)^a\left(\frac{v_b^2}{gd_p}\right)^b\left(\frac{\rho_g v_b d_p}{\mu}\right)^c\left(\frac{D_T}{W}\right)^d\left(\frac{D_T}{H}\right)^e(\mu_w)^f(v)^g \tag{31}$$

A group involving $d_p$ and $D_T$ has been omitted as some other groups already represent these quantities. Similarly, v has been neglected because in 2D cold model wall particle friction would be dominating rather than inter-particle friction. Moreover, the value of ϕ changes with the gas flowrate (R. Jackson and M. R. Judd, Further consideration on the effect of aeration on the flowability of powders, Trans IchemE, 59 (1981) 119) which makes difficult to assign it single value.

The first dimensionless group on the right side is related to pressure drop. Second group is Froude number which gives the ratio of inertial to gravitational forces. It is used to describe the gas/solid/liquid systems. Many previous authors have correlated raceway size with this number. The third group is well known Reynolds number. The left hand side group of equation (30) is known as raceway penetration factor.

From the experimental values, obtained in the velocity increasing case, the values of dimensionless groups are evaluated. The resulting data is then subjected to regression analysis to determine the constants a, b, c, d, e, f, and k. The values of the constants obtained are a=0.79, b=0.81, c=0.0035, d=0.88, e=0.89, f=−0.24 and k=243.5.

From these values it is clear that Reynolds number is of least significance. All other parameters are important. Therefore, after neglecting the Reynolds number term and performing regression analysis again one gets the values of the coefficients as a=0.79, b=0.81, d=0.85, e=0.88, f=−0.23 and k=247. It can be observed that there is not much change in the value of the coefficients after neglecting the Reynolds number. The effect of the Reynolds number is negligible because of the inertial conditions prevailing during the raceway experiments performed. Since the values of coefficients a, b, d and e are quite close, we can group them into a single dimensionless group and the simplify form of the correlation can be written as:

$$\frac{D_r}{D_T} = k\left(\frac{\rho_g v_b^2 D_T^2}{\rho_{eff}\, g d_{eff}\, HW}\right)^a (\mu_w)^b \tag{32}$$

Doing regression analysis again, we get the values of the coefficients as a=0.80, b=−0.25 and k=164. The $R^2$ value of the correlation was found to be 0.96. Therefore, the final form of the correlation for increasing velocity is:

$$\frac{D_r}{D_T} = 164\left(\frac{\rho_g v_b^2 D_T^2}{\rho_{eff}\, g d_{eff}\, HW}\right)^{0.80} (\mu_w)^{-0.25} \tag{33}$$

Velocity Decreasing Case: The correlation for the raceway diameter as before is given by:

$$\frac{D_r}{D_T} = k\left(\frac{\rho_g}{\rho_{eff}}\right)^a \left(\frac{v_b{}^2}{g d_{eff}}\right)^2 \left(\frac{\rho_g v_b d_{eff}}{\mu}\right)^c \left(\frac{D_T}{W}\right)^d \left(\frac{D_T}{H}\right)^e (\mu_w)^f \tag{34}$$

A regression analysis was performed on the experimental data, obtained in the gas velocity decreasing case, to determine the constants a, b, c, d, e, f, and k. The values of constants obtained are: a=0.60, b=0.62, c=−0.024, d=0.51, e=−0.095, f=−0.235 and k=3.3612. The $R^2$ value of the correlation was found to be 0.96.

As before, one can neglect the Reynolds number since its coefficient c is very small. Since the values of other coefficients a, b, and d are quite close, one can group these dimensionless groups into single group. Thus the simplify form of the correlation can be expressed as:

$$\frac{D_r}{D_T} = k\left(\frac{\rho_g v_b^2 D_T}{\rho_{eff}\, g d_{eff}\, W}\right)^a \left(\frac{D_T}{H}\right)^b (\mu_w)^c \tag{35}$$

where k, a, b and c have to be determined by regression analysis again. Using the above equation and performing regression analysis, one obtains the following final form of the correlation for decreasing velocity.

$$\frac{D_r}{D_T} = 4.2\left(\frac{\rho_g v_b^2 D_T}{\rho_{eff}\, g d_{eff}\, W}\right)^{0.6} \left(\frac{D_T}{H}\right)^{-0.12} (\mu_w)^{-0.24} \tag{36}$$

The $R^2$ value of the correlation was found to be 0.96.

Equations (32) and (35) are the desired raceway size correlations for increasing and decreasing velocity respectively. It is interesting to note that bed height and tuyere opening play an important role in increasing than decreasing velocity. The results obtained from these correlations will be compared with the experiments and plant data.

Experimental Plan:

Before the experimental procedure is described, it is necessary to distinguish between two types of two-dimensional apparatus (G. S. S. R. K. Sastry, G. S. Gupta and A. K. Lahiri, Ironmnkg & Steelmkg, 30 (1) (2003) 61) which have been used by various researchers. These are classified as pseudo two-dimensional and two-dimensional models. In two-dimensional model a tuyere in the form of a rectangular slot is introduced across the entire thickness of the model. This ensures a uniform blast velocity across the entire width and no expansion of the jet in the third dimension takes place. Thus the phenomenon is confined strictly to two dimensions. In pseudo two-dimensional models, jet of air is introduced through a tuyere (mostly circular) placed in the longitudinal central plane of the model and the phenomenon is observed from the sidewalls where the effects are visible. The jet can expand in front of the tuyere in all directions but it is assumed that there is negligible effect due to the jet expansion in the direction perpendicular to the tuyere axis. Most of the investigations on raceway have been done on pseudo two-dimensional model except by Flint & Burgess (1992), Litster et al. (1991) Sarkar et al. (1993), and (G. S. S. R. K. Sastry, G. S. Gupta and A. K. Lahiri, Int. ISIJ, 43 (2) (2003) 153). It is obvious that only two dimensional model can give better accuracy, therefore, only two dimensional models have been used in the present study.

As such the raceway size is a function of physical and frictional properties of the material and geometrical parameters of the experimental setup. Therefore, many experiments were performed to obtain the raceway size as a function of these parameters in both increasing and decreasing gas velocity. Table 2 shows the range of various variables (geometrical) along with experimental variables used during the experiments. All the particles, which were used during the experiments, were having the ratio of apparatus thickness (opening) to particle diameter always greater than 12 or more in order to avoid the wall effect. All experiments were carried out in two-dimensional cold models which were reinforced using iron bars to prevent the bulging. PVC slot tuyeres were used. A schematic diagram of the equipment is shown in FIG. 5.

The bed was packed with a desired material to a desired bed height above the tuyere level. Room temperature air was used as the blast gas to form the raceway. The air flow rate to the tuyere was increased gradually until the point at which the raceway just began to form, then it was shut off immediately. This procedure was necessary to clear the tuyere of the beads which entered the tuyere when the bed was filled. The air flow rate was then increased gradually from zero to the fluidisation limit of the bed in steps. At each step, two minutes were allowed for the raceway size to reach equilibrium, then the raceway penetration (size in the gas entry direction) and height were measured directly using a ruler and tracing the raceway boundary on a transparent graph paper. When the maximum gas flow rate for the experiment was reached, the flow rate was reduced through the same steps. Raceway penetration and height were measured in the same way. Each experiment was repeated at least thrice. However, average value has been reported. Various physical properties of the materials used in the experiment, are listed in Table 3. Hundreds of experiments were performed to obtain the raceway size by changing the dimensions of the apparatus, bed height, tuyere opening, gas flow rate and material properties.

TABLE 2

List of geometrical and experimental variables

| Apparatus Number | Bed dimensions (H × W × T), mm | Tuyere opening (mm) | Gas velocity (m/s) | Bed height, m | Material | Experimental condition |
|---|---|---|---|---|---|---|
| 1 | 2300 × 1000 × 100 | 6, 10, 25, 50 & 79 | 0–120 | 0.2–1 | Polyethylene | Both (increasing and decreasing velocity) |
| 2 | 1800 × 600 × 60 | 5 | 0–110 | 0.2–1 | Glass, Plastic | Both |
| 3 | 830 × 380 × 40 | 5.5 | 0–40 | 0.1–0.5 | Plastic, Mustard seed | Both |
| 4 | 700 × 285 × 17 | 5 | 0–25 | 0.1–0.5 | Quartz | Increasing |

TABLE 3

Physical properties of the materials

| Material | Shape | Density ($kg/m^3$) | Particle diameter (mm) | Particle wall friction ($\mu_w$) | Shape factor | Min. fluidization velocity (m/s) | Void fraction |
|---|---|---|---|---|---|---|---|
| Plastic | Spherical | 1080 ± 20 | 5.8 ± 0.04, 2.1 ± 0.1 | 0.22 | 1.0 | 1.37 (5.8 mm) 0.67 (2.1 mm) | 0.42 |
| Poly-ethylene | Cylindrical | 920 ± 30 | 4.1 (Equiv. Dia.) | 0.29 | 0.87 | 0.84 | 0.42 |
| Glass | Spherical | 2770 ± 90 | 2.7 ± 0.01 | 0.16 | 1.0 | 1.39 | 0.43 |
| Quartz | Irregular | 2550 ± 70 | Equiv. Dia. 1.09, 1.55 mm | 0.2 | 0.65 | 0.87 (for 1.55 mm) | 0.4 |
| Mustard | Spherical | 1070 ± 10 | 2.2 ± 0.2 | 0.22 | 1.0 | 0.69 | 0.39 |

Scientific Explanations:

Below, numerical results have been presented, based on developed mathematical model here, considering an experimental apparatus number 1 and polyethylene beads (see Tables 2 & 3). The angle of wall friction and inter-particle friction were measured using shear apparatus which were 15.6 and 38 respectively. However, in order to know the angle of inter-particle friction in presence of air, the equation suggested by Jackson and Judd (1981) was used which gives the value of internal angle of friction 28 at an average gas velocity of 40 m/s. Height (H) of the packed bed above the tuyere level is 1 m. The total width (W) and thickness of the model are 1 m and 0.1 m respectively. The value of $r_o$ [$=(W+D_t)/2\pi$] is 0.16 m. Therefore, the system is Cartesian from 0.16 m to 1 m (top of the bed surface). Value of n, measured experimentally, was 0.8. Before comparing experimental, plant data with theory/correlations, it is worthwhile to present the behaviour of stress and pressure in the packed bed so that hysteresis phenomenon can be understood properly.

Equations (14) and (21) describe the stress distribution in both Cartesian and radial regions respectively. FIG. 6 shows the stress distribution as a function of distance in a packed bed above the cavity region. Stresses have been plotted from the top of the bed to the cavity roof for both the decreasing and increasing velocity at 40 m/s. In both the cases, the normal stress increases at a decreasing rate in the constant velocity region (i.e. z=0.0 m to z=0.84 m). Beyond this i.e. in the radial region, the stress keeps on increasing. The increment in radial stress continues until it reaches a maximum value, few centimeters away from the cavity roof. After reaching this maximum value, stress starts decreasing rapidly as it approaches the cavity roof. On closely scrutinising the equation (20) it can be deduced that pressure gradient term is responsible for this behaviour of the stress in the radial region. This can also be seen from FIG. 7 in which pressure gradient has been plotted against the distance from the bed surface for both decreasing and increasing cases. Pressure gradient, given by Ergun equation (7), is constant in the Cartesian region, however, pressure gradient in the radial region is a function of the distance from the center of the cavity and increases asymptotically close to the cavity roof. From FIG. 7, it is clear that the value of pressure gradient is two orders of magnitude greater (close to the cavity roof) than the value of pressure gradient in the constant velocity region.

The very high pressure gradient close to the cavity is responsible for the decrease in radial stress near the cavity roof. In the increasing velocity, the normal stress is always greater than the decreasing velocity as pressure drop is always higher in former case 7. This is one of the reasons that cavity size is less in the increasing velocity.

In order to verify the proposed theory, experimental and published data have been compared with the theoretical predictions and results are presented below.

A comparison between the measured (published, Apte et al. (1990)) static pressure with the present theory is shown in FIG. 8. As such the agreement between the measured and theoretical data is good except near the raceway roof which is due to the severe fluctuations in pressure which could lead the error in measurement up to 30%. Also a small difference in the location of measuring probe could give a very different result. Besides the above mentioned factors, there is also the discrepancies in the measured static pressure values as reported in the paper. For example, table in the paper shows raceway size 0.041 m while figure shows 0.035 m. Similarly, the bed height is reported 0.5 m while figure shows 0.55 m. However, for comparison we have taken operating data from the table as mentioned in the paper. Published pressure gradient values, Apte et al. (1990), (derived from the pressure measurement curve) also show a good agreement with the presenttheory which has not been reported here.

From equation (28), it is clear that it can be solved for the cavity radius R as other parameters are known. Prediction of the cavity size in the increasing velocity is given in FIG. 9. As seen from this figure, when one starts increasing the velocity, cavity does not form until a critical velocity is reached. Initially, there is no cavity formation since the pressure force exerted by the gas is unable to overcome the frictional force and bed weight. Later when the velocity (or pressure force) is sufficiently high to overcome these forces, void or cavity starts forming. From this point onwards as one increase the velocity, the cavity size keeps on increasing. In another way, one can say that when the bed is in static condition (no gas flow), friction is acting in upward direction (due to the downward movement of the particles during bed filling). As soon as the gas is introduced friction try to resist the force exerted by the gas. As the pressure force keeps on increasing with the increase in velocity, frictional force starts acting in reverse direction and becomes fully mobilized when the formation of cavity occurs. FIG. 9 also shows a comparison between experimental (Sarkar et al., 2003) and theoretical values of cavity size. Within the experimental errors, very good agreement exists.

FIG. 10 compares the theoretical and experimental cavity hysteresis. The constant region of cavity size in theoretical prediction is plotted based on the following arguments. Theoretically, it was found that the normal stress (and thus the frictional force) was higher in the velocity increasing case than in the velocity decreasing case at a particular gas velocity (see FIG. 6). The frictional force at the maximum gas velocity in the velocity increasing case is known (from an almost similar equation as in decreasing velocity (26)) and thus the maximum cavity size. In the velocity decreasing case, this maximum cavity penetration was taken as constant for each gas velocity until the frictional forces in the decreasing case attained a value equal or lower than the frictional force corresponding to the maximum gas velocity in the velocity increasing case. In other words, it is assumed that the frictional forces in the velocity decreasing case are fully mobilized when they become almost equal to the frictional force corresponding to the maximum gas velocity in the velocity increasing case. Therefore, one keeps the cavity size constant in the decreasing velocity until it obtains a value lower than that obtained at the maximum blast velocity in the velocity increasing case. Based on the above arguments, one can present the results in the region where there is not much change in the cavity penetration with the blast velocity as shown in FIG. 9. A reasonable agreement can be seen at decreasing gas velocity between the two values. Slight disagreement in the value could be due to two reasons. Firstly, during experimental measurement of cavity, its size can vary by ± two particles diameter. The difference between the theoretical and experimental values is not more than two particle diameters as it can be seen from FIGS. 9 and 10. Secondly, the values of internal and wall angles of friction may change with change in pore pressure as reported by Terzaghi, K., Peck, R. B. & Mesri, G. 1996 Soil Mechanics In Engineering Practice. 3$^{rd}$ Edition John Wiley New York, and Jackson and Judd (1981). A constant value of these angles at all gas flow rate has been considered in the present study. Nevertheless, it can be concluded that using the frictional force in the force balance, it is possible to predict the cavity penetration in the velocity increasing and decreasing cases with a fair degree of accuracy.

FIG. 11 shows a plot of cavity diameter vs. gas velocity without considering the frictional forces along with a theoretical hysteresis curve. It is obvious that a force balance approach based on gas momentum and bed weight terms can not give the correct results. Certainly, frictional forces play an important role in describing the packed bed behaviour. Moreover, these two forces can not explain the hysteresis phenomena as they will give only one set of data in both the cases i.e. increasing and decreasing gas velocity.

Discussion, Novelty and Inventive Steps:

Two important observations were made during this study. Firstly, frictional forces play an important role in the overall force balance to describe the hysteresis phenomena as shown in FIG. 11. Only after considering these frictional forces one would be able to describe the behaviour of a packed or fluidized or spouted bed properly. Tsinontides, S. C. and Jackson, R. 1993 The mechanics of gas fluidized beds with an interval of stable fluidization. *J. Fluid Mech.* 255, 237–274, had neglected the wall-particle frictional force. However, they had recognized the importance of it but were unable to take into account of it in explaining the results. Indeed, it has been found from the theory, presented here, that as the angle of wall-particle is decreased, hysteresis in the bed reduces (and thus the cavity size increases) which is in agreement qualitatively with the experiments reported by Sarkar et al. (2003). In fact, if friction were removed completely, we would argue there should be no hysteresis at all. Obviously, friction has a pronounced effect on hysteresis and can not be neglected. Secondly, there have been wide variations in the literature about handling the direction of stresses as explained earlier in the prior art section. This we have clearly demonstrated by theory, presented here, and experiments done by Sarkar et al. (2003), that frictional forces will change the direction depending upon the upward or downward movement of solids. From this theory, it is clear that while increasing blast velocity, the frictional force will act downward. However, Apte et al. (1990) have considered it in the upward direction. In case of Doyle III et al. (1986), since there is a downward movement of the solids, the shear stress will act in the upward direction. They have considered it in the downward direction. Pressure force always acts in the upward direction and bed weight always acts in the downward direction. Indeed, Chong, Y. C., Teo, C. S. & Leung, L. S. 1985 *Encyclopedia of Fluid Mechanics*. Cheremisinoff, N. P. (Ed) 4, 1127–1144, had also mentioned about it in explaining the hysteresis in fluidized bed. Tsinontides & Jackson (1993) tried to explain fluidization and bubbling regime hysteresis by introducing a complicated assumption of compressive and tensile stresses which they had related to void fraction. As such there is no significant variation in the void fraction in a packed bed, therefore, the above concept may not be applicable.

Two new correlations have been developed to predict the cavity size in increasing and decreasing gas velocity in the stationary/moving bed. These correlations were developed based on a systematic experimental study and then applying dimension analysis taking care of frictional properties of the particulate. No one has done this study before and developed the correlations in a systematic way as discussed in prior art section. Similarly, one-dimensional analytical mathematical model has been developed based on force balance approach proposed by us as new theory and discussed in the prior art section. Again, no investigator has developed such a model. Also no mathematical model is available which can describe the hysteresis phenomena in packed/spouted/fluidized beds except the one which has been developed here. Both the correlations and mathematical model have tremendous industrial application potential some of them have been discussed under examples section below.

BRIEF DESCRIPTION OF THE ACCOMPANYING DRAWINGS

In the drawings accompanying the specification,

FIG. 1 illustrates the experimental cavity hysteresis with the packed bed.

FIG. 2 illustrates the packed bed showing the essential regions used for modeling.

FIG. 3 illustrates the forces acting on an element in the Cartesian region.

FIG. 4 illustrates the forces acting on an element in the radial region.

FIG. 5 illustrates the schematic diagram of the experimental setup.

FIG. 6 illustrates the hysteresis curve of normal stress at velocity=40 m/s.

FIG. 7 illustrates the variation of pressure gradient with distance from the bed surface.

FIG. 8 illustrates a comparison of static pressure with experimental data.

FIG. 9 illustrates a comparison between theoretical and experimental cavity size for increasing velocity.

FIG. 10 illustrates a comparison between theoretical and experimental cavity hysteresis.

FIG. 11 illustrates a comparison between theoretical cavity size considering and not considering the frictional forces.

FIG. 12 illustrates a comparison of correlation raceway with published Flint and Burgess (1992) data of 3 mm polystyrene.

FIG. 13 illustrates a comparison of correlation raceway with published Flint and Burgess (1992) data of 0.725 mm ballotini glass.

FIG. 14 illustrates a comparison of model's prediction with experimental (Born, 1991) values of cavity size.

FIG. 15 illustrates a comparison of experimental (Sastry, 2000) and theoretical values of cavity size.

FIG. 16 illustrates a comparison of raceway size between experimental and correlation in both increasing and decreasing velocity.

FIG. 17 illustrates a comparison of blast furnace (Hatano et al., 1977) and experimental data for both increasing and decreasing velocity conditions.

FIG. 18 illustrates a comparison of correlation raceway size with published (Wgastaff, 1957) blast furnace data.

FIG. 19 illustrates a comparison of correlation raceway size with published blast furnace data of Nishi et al., 1982.

FIG. 20 illustrates a comparison of correlation raceway size with published blast furnace data of Poveromo et al., 1975.

FIG. 21 illustrates a flow chart for determination of cavity/raceway size in packed bed like ironmaking & lead blast furnaces, corex, cupola, etc. for decreasing gas velocity based on mathematical model.

FIG. 22 illustrates a flow chart for determination of cavity/raceway size in packed bed like ironmaking & lead blast furnaces, corex, cupola, etc. for decreasing gas velocity based on decreasing correlation.

FIG. 23 illustrates a flow chart for determination of maximum velocity/cavity size in a spouted bed above which spout will form/or condition of instability in packed bed based on mathematical model.

FIG. 24 illustrates the flow chart for determining cavity/raceway size in packed bed like ironmaking & lead blast furnaces, corex, cupola, etc.

EXAMPLES

Examples 1–5

It was discussed in the beginning that many correlations have been proposed to predict the cavity size but they are not in agreement with each other. Now, it is the time to validate the proposed correlations and mathematical model to see whether they can represent the experimental data of other researchers'.

FIG. 12 shows a comparison of raceway diameter obtained using the correlation and published experimental values for a 2D cold model (Flint and Burgess (1992)). The experimental values of the raceway diameter have been obtained for polystyrene beads of diameter 3 mm, bed height from the tuyere level 800 mm, and tuyere opening 5 mm. Angle between the wall and particle was taken 18 (F. Born, B. E. (Hons) Thesis, University of Queensland, Australia, 1991). Other values are given in Flint and Burgess (1992). Average raceway diameter was used in plotting the value as data were available for raceway penetration and raceway height. There is good agreement between the experimental values of average raceway diameter and that obtained using the correlation with the maximum error equal to the two particles diameter except at the maximum blast velocity which is close to the fluidisation limit and one can not expect a good agreement for those values. It should be noted that correlation gives the diameter of the raceway which could be little different from the raceway penetration or average raceway diameter as reported by many investigators. In the same figure, prediction by mathematical model has also been plotted and one can see an excellent agreement between the experimental and theoretical results.

Another published experimental result (Flint and Burgess (1992)) along with correlation data for the glass bead of diameter 0.725 mm, bed height from the tuyere level 800 mm and tuyere opening 5 mm is given in FIG. 13. The results are for 2D cold model in increasing gas velocity condition. Average diameter of the raceway has been calculated from the published value and has been plotted in this figure.

Wall-particle angle was taken 12.4 (Apte et al. (1990)). There is good agreement between the experimental values of average raceway diameter and that obtained using the correlation.

Born (1991) has used polystyrene beads for 2D experiments using apparatus number 1 (see Table 2). Comparison of model's predictions with Born (1991) experimental data, in increasing velocity, is shown in FIG. 14. Because these data were used to develop the correlations therefore, correlations results are not compared. A good agreement is apparent between the two.

G. S. S. R. K. Sastry, M. Sc. (Engg) Thesis, Indian Institute of Science, Bangalore, September 2000, has used quartz as particulate material in his increasing velocity experiments using 2D apparatus number 4 (see Table 2). The properties of these materials are given in Table 3 along with other parameters. A comparison is shown in FIG. 15. Correlation's results are not shown in this figure because these data were used to develop the correlation. Again a good agreement is apparent between the two.

Our experimental data has already been compared with mathematical model in FIG. 10 above.

A comparison between the experimental and predicted (using correlation equation (35)) raceway size for decreasing gas velocity is shown in FIG. 16. The plot is for plastic beads of diameter 2.1 mm. Bed height was 600 mm from tuyere level and tuyere opening was 5.5 mm. Apparatus number 3 (see Table 2) was used during the experiments. An excellent agreement between them is apparent.

It should be mentioned here that plastic beads data were not used to develop the present correlations. The linear decrease in the raceway penetration with blast velocity is predicted well by the correlation. Similarly, one can see a good agreement between the two values in increasing gas velocity as shown in the same figure. Mathematical model's results are also shown in the same FIG. 16 for increasing velocity. A good agreement is evident.

Examples 6–8

It was mentioned in the prior art section that raceway size obtained in decreasing gas velocity is more relevant to operating blast furnaces than increasing gas velocity. It is because large amount of coke is consumed near the raceway during combustion and in reducing the ore. This coke is replenished from the top of the raceway. Also intermittently iron and slag is tapped from the bottom due to which coke descends. It has also been found (MacDonald & Bridgewater, 1993) that the decreasing gas velocity condition is applicable to the case of a moving bed as in the case of blast furnace. It was observed that the horizontal injection into a moving bed gives effects similar to those encountered with vertical injection into a moving bed. So the decreasing correlation results can be applied to the moving bed irrespective of whether there is horizontal or vertical injection of the gas.

All the previous correlations, which have been given for the raceway penetration till now, are mainly for the increasing velocity. There is a doubt of their applicability to the blast furnaces. Now, it is the time to verify two points:

1. Whether the decreasing gas velocity is relevant to blast furnace or increasing, and
2. Whether the developed correlation, based on cold model results, can represent the commercial blast furnace.

FIG. 17 shows the raceway factor values plotted as a function of penetration factor obtained using the correlation in the both velocity increasing and decreasing cases along with the blast furnace data (Hatan0 et al., 1977). For the sake of comparison, data obtained from mathematical model have also been included in the same figure. In this figure data obtained from the correlation and model are based upon the cold model experimental data for the case of apparatus 1, tuyere diameter 6 mm, bed height 1 m and polyethylene beads of equivalent diameter 4.1 mm. There is an excellent agreement between the raceway factor values obtained in the velocity decreasing case with the blast furnace data when plotted as a function of penetration factor. It confirms both the points mentioned above that raceway size obtained in decreasing velocity is more relevant to commercial blast furnace and the correlations/mathematical model developed here reasonably predict the raceway size.

In FIG. 17, it was difficult to compare the raceway size against gas velocity using actual blast furnace data due to unavailability of many data. In fact, in most of the published work on commercial blast furnace, many data are missing. However, we have managed to extract most of the data from these papers. Some of the values have been assumed in a reasonable way which are described during the discussion of a particular figure.

Wagstaff et al. (1957) reported the data of commercial blast furnaces almost half a century ago. That time blast furnace technology was not so advanced. We were able to extract most of the data which are required by the correlation and model to predict the raceway size except the height of the burden, coke size, apparent density of solid and hearth radius (as W in the correlation). After going through few text books (The Iron and Steel Institute of Japan, Blast Furnace Phenomena and Modelling, Elsevier Applied Sci., London, (1987) and A. K. Biswas: Principles of Blast Furnace Ironmaking, SBA publications, Calcutta, 1984) coke size was assumed 40 mm and apparent density of coke was assumed 900 kg/m$^3$. These values were kept constant in other papers also (if applicable). Hearth diameter, especially for the old furnaces of 1950, was assumed 7 m. Burden height was calculated, for all authors, as effective burden height using formula suggested by Sastry et al. (2003). They have shown, based on stresses at the bottom of a 2D apparatus and using modified Janssen equation for two-dimension case, that pressure becomes almost constant at the bottom of the apparatus after certain burden height. Using their formula and assuming 15 m burden height, it was found that pressure at the bottom becomes constant after 5 m of burden height. Therefore, this height (5 m) was taken as effective burden height for all commercial furnaces. It was also found that if burden height is taken to 20 m then there is hardly any change in the effective bed height.

FIG. 18 shows a raceway size comparison between the plant data (Wagstaff et al., (1957)) and correlation with gas velocity. Correlation data have been plotted for decreasing velocity. Similarly, decreasing data obtained from the model has also been plotted in the same figure. Errors bar are also shown in the plant data. It is pleasing to see an excellent agreement between them. Because our correlations and mathematical model are based on two-dimensional model, therefore, tuyere diameter area was converted in to equivalent 2D tuyere area and then $D_T$, tuyere opening, was calculated. Diameter of the furnace tuyere was taken as the thickness of the apparatus for slot tuyere.

FIG. 19 shows another comparison between the correlation and Japanese blast furnaces (T. Nishi, H. Haraguchi, Y. Miura, S. Sakurai, K. Ono and H. Kanoshima, ISIJ, 1982, vol. 22, pp. 287–296). In this paper all the data were available except apparent density of coke which was taken 900 kg/m$^3$ as described before. Again a good agreement exists between the two. The difference between the two values is mostly within the limit of ± two to four particles diameter. For comparison purpose, increasing velocity data, has also been plotted in the same figure. It is obvious that decreasing velocity data are relevant to blast furnaces and are well represented by decreasing cold model correlation.

Another comparison of correlation with operating blast furnace data (J. J. Poveromo, W. D. Nothstein and J. Szekely: Ironmaking Proc., 1975, vol. 34, pp. 383–401) is shown in FIG. 20. In this figure also, almost all data were given in the literature except coke size and its apparent density which were taken as 40 mm and 900 kg/M$^3$ respectively. Again a good agreement exists between the two. Figure also shows the errors bar in the plant data.

Example 9

The model developed here has provided a basic frame work to describe the complex phenomena of hysteresis in packed, fluidized and spouted beds including the stresses (between the particles and wall and particles) in a force balance which include gas drag and particles weight. At this point, it is important to make some comments on the nature of the equation (21). Stress can be estimated using equation (21). From this equation it can be seen that $\sigma_r$ is strongly dependent on the pressure drop in the bed. Under fluidized bed condition, the bed weight is equal to pressure drop and thus $\sigma_r$ would be zero. If pressure drop is greater than bed weight then $\sigma_r$ may become negative. However, in the packed bed, particles are in contact with each other and with the container wall therefore, $\sigma_r$ may not achieve a negative or zero value unless the bed approaches fluidized condition. This is an important conclusion as Apte et al. (1990) assumed that $\sigma_r$ could achieve a negative value above the cavity roof. Tsinontides & Jackson (1993) has also ruled out that $\sigma_r$ could achieve a negative value. Obviously, Apte et al. assumption was incorrect in explaining experimental hysteresis. Using equation (21), the velocity at which a bed may become unstable/fluidized can be found provided all the properties of the particulate material and gas are known. From FIG. 6 it is clear that there is a maximum value of radial stress exist above the cavity roof for a particular gas velocity. This maximum value of stress decreases with increase of gas velocity. This indicates that to make the bed unstable/fluidized, one has to overcome this maximum stress by increasing the gas velocity. Therefore, it is possible that at a particular gas velocity the system can overcome this maximum value of stress and will become unstable/fluidized. Indeed, during our experiments it was found that the bed becomes unstable when we approach a velocity close to 142±5 m/s. Using equation (21), the velocity for unstable bed was found 140 m/s which is an excellent agreement.

Conclusions:

Two raceway size correlations have been developed one each for increasing and decreasing velocity under the cold model conditions. Frictional properties of the material have also been included in these correlations. Raceway size obtained from the correlations and other data such as published cold & hot model, plant and experimental data match very well. It has been shown that decreasing conditions prevails in the operating blast furnace and therefore, decreasing correlation can be used to predict the raceway size. Both the correlations are able to predict the raceway hysteresis in cold model. It has been found that the frictional forces (and thus the frictional properties) have pronounced effect on the prediction of cavity size. In fact, the inclusion of frictional forces gives a universal form to the force balance approach to predict the cavity size. This is evident by comparing the theoretical data with published, experimental and plant data. An excellent agreement has been found between theory and experiments, not only with our experiments but also with other researchers experiments under various conditions. With the help of mathematical model, the maximum operating velocity of any packed bed can be found, above which the bed may become unstable and thus its operation.

The main advantages of the present invention are:

1. It can explain the hysteresis phenomena correctly and shows the importance of frictional forces in packed/fluidized/spouted bed systems.
2. It can predict the cavity size in these systems so that their performance can be improved considerable in terms of heat, mass and momentum transfer.
3. It gives two simple working correlations, beside a mathematical model, to predict the cavity size one each in increasing and decreasing velocity respectively.
4. It shows cavity size pertaining to decreasing gas velocity is relevant to operating blast furnaces.
5. Mathematical model can also give the maximum operating gas velocity for any packed bed above which it may become unstable.
6. Both model and correlations have been tested under wide variety of conditions (see examples 1–9) and they give very good results. Therefore, they can be used directly in the industries.
7. No other models and correlations have the above mentioned features until now.

What is claimed is:

1. A computer based method for determining cavity size in packed bed systems, the method comprising:

a) retrieving data parameters related to material properties of a packed bed system, the parameters including at least: a blast furnace radius (W), an effective bed height (H), a blast velocity ($v_b$), a tuyere opening ($D_t$) a void fraction ($\epsilon$), a gas viscosity ($\mu_g$), a particle size ($d_p$), a shape factor ($\Phi_s$), a density of gas ($\rho_g$), a density of solid ($\rho_s$), a coefficient of wall friction ($\mu_w$), an acceleration due to gravity (g), an effective particle diameter given by $d_{eff}=d_p\Phi_s$, an effective bed density given by $\rho_{eff}=\epsilon\rho_g+(1-\epsilon)\rho_s$, a wall-particle frictional coefficient given by $\mu_w=\tan\Phi_w$, wherein $\Phi_w$ is an angle of friction between the wall and the particle, wherein $D_r$ is a cavity diameter, and wherein all units are in SI:

b) determining a cavity radius (R) for both increasing gas velocity and decreasing gas velocity, the determined cavity radius given by:

$$2nR^2 - 2nHR + \frac{pn\beta v_b^2 D_T^2}{2\pi^2 M}\left\{\ln\frac{W}{2\pi} - \ln\left(R - \frac{D_T}{2\pi}\right\} + \left(\frac{2r_o}{M\pi}(\alpha + \beta v_H)v_H(H - r_o) - \frac{F_{wd}}{M\pi}\right) = 0 \quad (29)$$

and $$2nR^2 - 2nHR + \frac{pn\beta v_b^2 D_T^2}{2\pi^2 M}\left\{\ln\frac{W}{2\pi} - \ln\left(R - \frac{D_T}{2\pi}\right\} + \left(\frac{2r_o}{M\pi}(\alpha + \beta v_H)v_H(H - r_o) + \frac{F_{wd}}{M\pi}\right) = 0 \quad (28)$$

respectively;

c) determining a cavity size using the cavity radius obtained in step (b); and d) storing the determined cavity size in a memory.

2. A method as claimed in claim 1, wherein the data related to material properties of the packed bed comprise at least: bed height, tuyere opening, void fraction, wall-particle friction coefficient, inter-particle frictional coefficient, gas velocity, model width and particle shape factor.

3. A method as claimed in claim 1, wherein the frictional force ($F_{wd}$) in equations 28 and 29 is given by:

$$F_{wtd} = -\frac{4n\pi\mu_w KhpM}{3\left(1-\frac{\mu_W K}{n\pi}\right)}\left\{\left(r_o-\frac{D_T}{2\pi}\right)^3-\left(R-\frac{D_T}{2\pi}\right)^3\right\}-$$

$$4pr\mu_w K\frac{\beta v_b^2 D_T^2}{4\pi\left(1+\frac{\mu_W K}{n\pi}\right)}(r_o-R)+$$

$$\frac{4n\pi\mu_w K\left(\frac{W}{2\pi}\right)^{1-\frac{\mu_W K}{n\pi}}hpM}{\left(1-\frac{\mu_w K}{n\pi}\right)\left(2+\frac{\mu_w K}{n\pi}\right)}\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}+$$

$$4pn\mu_w K\left(\frac{\beta v_b^2 D_T^2}{4\pi}\right)\times\frac{1}{\left(\frac{W}{2\pi}\right)^{1+\frac{\mu_W K}{n\pi}}\left(1+\frac{\mu_w K}{n\pi}\right)\left(2+\frac{\mu_w K}{n\pi}\right)}$$

$$\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}+$$

$$\frac{2pWn\pi}{\left(2+\frac{\mu_w K}{n\pi}\right)}\left(\frac{W}{2\pi}\right)^{-\frac{\mu_W K}{n\pi}}\times\left\{M-\frac{\alpha v_b D_T}{W}-\frac{\beta v_b^2 D_T^2}{W^2}\right\}$$

$$\left\{1-e^{-C\left(H-\frac{W+D_T}{2\pi}\right)}\right\}\left\{\left(r_o-\frac{D_T}{2\pi}\right)^{2+\frac{\mu_W K}{n\pi}}-\left(R-\frac{D_T}{2\pi}\right)^{2+\frac{\mu_W K}{n\pi}}\right\}+$$

$$W\left(\frac{W+D_T}{\pi}\right)\left\{M-\frac{\alpha v_b D_T}{W}-\frac{\beta v_b^2 D_T^2}{W^2}\right\}\left[(H-r_o)+\frac{\{e^{-C(H-r_o)}-1\}}{C}\right]$$

4. A method as claimed in claim 1, wherein the packed bed system includes at least one of: a blast furnace, a cupola, a corex, or a catalytic regenerator.

5. A computer based method for determining the cavity size in packed bed systems, the method comprising:

a) retrieving data parameters related to material properties of a packed bed system, the parameters including at least: a blast furnace radius (W), an effective bed height (H), a blast velocity ($v_b$), a tuyere opening ($D_t$), a void fraction ($\epsilon$), a gas viscosity ($\mu_g$), a particle size ($d_p$), a shape factor ($\Phi_s$), a density of gas ($\rho_g$), a density of solid ($\rho_s$), a coefficient of wall friction ($\mu_w$), an acceleration due to gravity (g), an effective particle diameter given by $d_{eff}=d_p\Phi_s$, an effective bed density given by $\rho_{eff}=\epsilon\rho_g(1-\epsilon)\rho_s$, a wall-particle frictional coefficient given by $\mu_w=\tan\Phi_w$, wherein $\Phi_w$ is an angle of friction between the wall and the particle, wherein $D_r$ is a cavity diameter, and wherein all units are in SI;

b) determining a cavity radius (R) for both increasing gas velocity and decreasing gas velocity, the determined cavity radius based on dimensionless numbers given by:

$$\frac{D_r}{D_T}=4.2\left(\frac{\rho_g v_b^2 D_T}{\rho_{eff}\, g d_{eff}\, W}\right)^{0.6}\left(\frac{D_T}{H}\right)^{-0.12}(\mu_w)^{-0.24} \tag{36}$$

$$\frac{D_r}{D_T}=164\left(\frac{\rho_g v_b^2 D_T^2}{\rho_{eff}\, g d_{eff}\, HW}\right)^{0.80}(\mu_w)^{-0.25} \tag{33}$$

respectiveiy;

c) determining a cavity size using the cavity radius obtained in step (b); and d) storing the determined cavity size in a memory.

6. A method as claimed in claim 5, wherein the data related to material properties of the packed bed comprise at least: bed height, tuyere opening, void fraction, wall-particle friction coefficient, inter-particle frictional coefficient, gas velocity, model width and particle shape factor.

7. A method as claimed in claim 5, wherein determining the cavity radius using increasing velocity as given by equation 33 includes using a π-theorem to calculate dimensionless numbers given by:

$$\frac{D_r}{D_T}=164\left(\frac{\rho_g v_b^2 D_T^2}{\rho_{eff}\, g d_{eff}\, HW}\right)^{0.80}(\mu_w)^{-0.25}$$

8. A method as claimed in claim 5, wherein determining the cavity radius using decreasing velocity as given by equation 36 includes using a π-theorem to calculate dimensionless numbers given by:

$$\frac{D_r}{D_T}=4.2\left(\frac{\rho_g v_b^2 D_T}{\rho_{eff}\, g d_{eff}\, W}\right)^{0.6}\left(\frac{D_T}{H}\right)^{-0.12}(\mu_w)^{-0.24}$$

9. A method as claimed in claim 5, wherein the packed bed system includes at least the one of: a blast furnace, a cupola, a corex, or a catalytic regenerator.

* * * * *